US006354248B1

(12) United States Patent
Bourke

(10) Patent No.: US 6,354,248 B1
(45) Date of Patent: Mar. 12, 2002

(54) HEAT EXCHANGE ELEMENT FOR A WATER HEATER FLUE

(75) Inventor: Brendan V. Bourke, Gordon (AU)

(73) Assignee: Southcorp Australia Pty. Ltd. (AU)

( * ) Notice: Subject to any disclaimer, the term of this patent is extended or adjusted under 35 U.S.C. 154(b) by 0 days.

(21) Appl. No.: 09/331,536

(22) PCT Filed: Dec. 23, 1997

(86) PCT No.: PCT/AU97/00878

§ 371 Date: Jul. 12, 1999

§ 102(e) Date: Jul. 12, 1999

(87) PCT Pub. No.: WO98/28578

PCT Pub. Date: Jul. 2, 1998

(30) Foreign Application Priority Data

Dec. 24, 1996 (AU) ..... P0 4346

(51) Int. Cl.[7] ..... F22B 13/02

(52) U.S. Cl. ..... 122/18.31; 122/44.2; 122/155.2; 138/38; 29/890.046

(58) Field of Search ..... 122/18.31, 44.2, 122/155.2, 48, 155.1; 138/38, 39; 165/109.1, 183; 29/890.046, 890.03

(56) References Cited

U.S. PATENT DOCUMENTS 2,541,175 A * 2/1951 Osterheld ..... 122/18.31
2,726,681 A * 12/1955 Gaddis et al. ..... 138/38
2,930,405 A * 3/1960 Welsh ..... 138/38
4,273,811 A * 6/1981 Okamoto et al. ..... 427/232

FOREIGN PATENT DOCUMENTS

GB 232406 * 4/1925
GB 668517 * 3/1952
GB 668518 * 3/1952

* cited by examiner

*Primary Examiner*—Jiping Lu
(74) *Attorney, Agent, or Firm*—Schnader Harrison Segal & Lewis LLP

(57) ABSTRACT

The present invention relates to heat exchange elements and heat exchange assemblies and water heaters containing such heat exchange elements. The inventive heat exchange elements include an elongated support member or spine, from which extends either a single vane which is the length of the support member of a series of vanes. The heat exchange element is able of be positioned parallel to the longitudinal axis of a flue. The heat exchange element may impart helical motion to the flue gases in one embodiment, but in another embodiment no helical motion is imparted to the flue gases. The embodiment of the invention includes several methods of manufacture of the heat exchange elements. The embodiments of the water heater and heat exchange assembly also disclose the use of a baffle for use in association with the elements, to improve the efficiency of the elements at the upstream end of the water heater.

36 Claims, 18 Drawing Sheets

18
4
50
14
14
14

HEAT EXCHANGE ELEMENT FOR A WATER HEATER FLUE

FIELD OF THE INVENTION

The present invention relates to water heaters, water heater flues and heat exchange elements which are or can be installed in flues of water heater systems.

BACKGROUND OF THE INVENTION

Prior art heat exchangers for hot water heaters generally comprise individual fins or vanes welded in predetermined patterns on the flue, so that air passing through the flue will be caused to flow in a spiral fashion. The fins or vanes also act as heat exchange elements which help to conduct heat to the flue wall and thus to the water contained in the vessel through which the flue passes.

In Australian patent application 18306/76 published on Apr. 13, 1978 there was described a series of individual vanes placed in helical fashion around the circumference of a flue and angled to the longitudinal direction of the flue so as to produce a swirling effect. Each vane was individually welded to the flue.

U.S. Pat. No. 2,950,740 which issued on Aug. 30, 1960, describes a similar arrangement to that described in the Australian patent application 18306/76. Whereas U.S. Pat. No. 3,349,754 which issued on Oct. 31, 1967 discloses a modified construction to that of U.S. Pat. No. 2,950,740, but modified by the individual vanes terminating at a central core region of the flue. Each of the above US patents, like the Australian reference, discloses individually located and welded vanes or fins. These vanes or fins arm relatively time-consuming to install if welded to the flue manually. Otherwise, to weld by machine requires complicated and expensive machinery.

Another difficulty with prior art constructions is that those fins closest to the combustion chamber tend to oxidise and progressively disintegrate. This can occur because of the damage caused by the absorption of excessive heat.

Corrosion can also occur in the fins elsewhere along the flue, if the flue is relatively efficient in extracting heat form the exhaust gases. This is particularly the case at the downstreams portions of the flue, because by the time the gases reach these portions, the temperature of the exhaust gases can drop below the dew point of the moisture contained in the gases. This will result in deposition of moisture on the downstream portions of the flue. If moisture builds up sufficiently and if combustion in the combustion chamber is switched off (such as when the water reaches the desired temperature), then the moisture can spread or drip to other portions of the flue causing erosion and creating a relatively hostile environment for the flue and fins.

One common solution to this moisture, corrosion and hostile environment is to enamel the interior of the flue. However, with individual fins being welded to flues, this is generally not done, because of difficulties in attempting to enamel fins having sharp edges and the like. In such situations it has been found that enamel does not stick the fins. If they are enamelled, because the enamel may only temporarily stick to the metal, and because of the hostile environment at the upstream end of the flue, the excessive heat will cause the enamel linings to disintegrate. Once this disintegration of the enamel occurs, corrosion or oxidation starts in the fins or vanes, which can then continue into other areas, accelerating the deterioration of the flue system, and thus the water heater.

SUMMARY OF THE INVENTION

The present invention provides a heat exchange element adapted to be attached to a surface of a flue of a water heater, and having an imaginary X axis along its length and an imaginary Y axis across its width being orthogonal to said X axis, and an imaginary Z axis orthogonal to the X and Y axes; said Z axis having a positive and negative direction, said negative direction beginning at, and extending away from a rear surface and said positive direction beginning at, and extending away from a front surface; a support member extending in the X axis direction having at least one vane on each of two opposing sides of said support member, said vanes being spaced apart in the Y direction on the supporting member; said vanes extending generally away from said front surface in a direction having a positive Z direction component.

The present invention also provides a heat exchange element adapted to be attached to an inside surface of a flue of a water heater, and having an imaginary X axis along its length and an imaginary Y axis across its width orthogonal to said X axis and an Z axis orthogonal to the X and Y axes; said Z axis having a positive and negative direction, said negative direction beginning at, and extending away from a rear surface and, said positive direction beginning at, and extending away from a front surface; a support member extending in the X axis direction having at least one vane extending in a direction having a positive Z direction component away from said front surface and on at least one side of said support member, wherein said support member is of a length greater than the extent of said at least one vane from said support The present invention provides a heat exchange element including:

an elongate base portion, having front and rear longitudinally extending surfaces, the rear surface being of a profile to substantially match a surface of flue to which said element is to be attached;

a plurality of vanes arranged along the base portion and projecting forwardly relatively to said front surface, said element having an imaginary X axis along its length and an imaginary Y axis across its width, said Y axis being orthogonal to said X axis, and an imaginary Z axis orthogonal to the X and Y axes; said Z axis having a positive and negative direction, said negative direction beginning at, and extending away from the rear surface and said positive direction beginning at, and extending away from the front surface.

Preferably said element is formed from a sheet material and is folded into a desired shape.

Preferably said element is formed from a channel member.

Preferably said element is formed from a substantially L-shaped member.

Preferably said element is constructed so that the X axis is positionable substantially parallel to a longitudinal axis of a flue.

Preferably each vane is an elongated tab or finger like projection.

Preferably at least one vane is oriented at an angle in the range of 0° to 35° to said X axis.

Preferably there is located one vane only on each of two opposing sides of said element parallel to said X axis, each vane extending parallel to said X-axis and being of substantially the same length as said support member.

Preferably said element is constructed so that when said X axis is positioned substantially parallel to said longitudinal axis of said flue, said vane means is at substantially the same angle to said longitudinal axis of said flue as it is to said X axis.

Preferably said rear surface includes a contour which substantially matches the contour of a surface of a flue to which it is to be attached.

Preferably said contour renders said element positionable relative to said flue, so that said X axis is only positionable substantially parallel to said longitudinal axis of said flue.

Preferably said rear surface includes a shape which provides at least one band, extending parallel to said X axis, by means of which said element can contact and be attached to said inside surface of said flue.

Preferably said rear surface includes, about said X axis, an external radius, not larger than an inside radius of said flue, said external radius being adapted to be connected to said inside surface of said flue.

Preferably said rear surface of said support member has a contour, shape or radius which provides said rear surface with a concave or convex shape relative to said negative direction of said Z axis.

Preferably at one end of said element said vane or vanes terminate at a lesser distance from said support member than the vanes or a portion of the vane, at the second end of said element.

Preferably at one end of said element said vanes have the same length for a predetermined length of said element, whereupon the length of said vanes progressively decreases so that at another end the length from said support member of said vanes is the shortest length of the said vanes on said element.

Preferably said predetermined distance is in the range of 50% to 80% of the length of said element.

Preferably said support member is generally planar except for a contour on the rear face of said support member.

Preferably said vane or vanes are generally planar.

Preferably said vane or vanes is part helical.

Preferably said vane or vanes imparts a motion which is at least part helical, to gases flowing over them.

Preferably said vane means extend from two sides of said support member.

Preferably on one side or both sides of said support member there is a plurality of vanes.

Preferably said vanes are formed initially at an obtuse or acute angle to said Y axis on said support member prior to being folded or bent into a desired shape.

Preferably each vane or groups of vanes are at an angle to the X axis which is different from each other vane or other groups of vanes.

Preferably vanes or groups of vanes at one end of said element are at no, or the smallest angle to said X axis by comparison to the angle to said X axis of a vane at the other end of said element.

Preferably each subsequent vane along the length of the element is at a progressively larger angle to the X axis by comparison to said smallest angle.

Preferably gaps or spaces between adjacent vanes or in groups of adjacent vanes, are of a substantially constant dimension.

Preferably gaps or spaces bent adjacent vanes or in adjacent groups of vanes decreases from a maximum to a minimum from one end of said element to the other.

Preferably an end of said element to be positioned in an end of said flue which is nearest to a combustion chamber of a water heater, has one of, or a combination of two or more of the following: a larger gap or space between adjacent vanes than other gaps or spaces between adjacent vanes; a larger gap or space between adjacent vanes in a group of vanes than other gaps or spaces between adjacent vanes in adjacent groups of vanes; vanes with the smallest angle to the X axis by comparison to the angle of other vanes; the group of vanes with the smallest angle to the X axis by comparison to the angle of other groups or another group of vanes, the shortest vane by comparison to the length of other vanes; the group of shortest vanes by comparison to the length of another group or other groups of vanes; the narrowest vane by comparison to the width of other vanes; the group of narrowest vanes by comparison to the width of another group or other groups of vanes.

Preferably said heat exchange element is secured to a flue of a fire water heater.

Preferably said heat exchange element is coated with enamel after it is installed in said flue.

The invention also provides a fired water heater including a heat exchange element as described in any of the above paragraphs, located in a flue of said water heater.

Preferably the fired water healer includes a baffle is located said flue at an upstream end thereof, to direct exhaust gases through said beat exchange elements.

Preferably said baffle includes a cylinder closed at one end.

Preferably said baffle includes a flange at one end of said cylinder to support said end of said cylinder from the vane or vanes of said heat exchange element, with said cylinder extending in an upstream direction from the downstream-most end of said heat exchange element.

The invention further provides a method of manufacturing a heat exchange element, said method including the step of: selecting or forming a generally planar elongate piece of sheet metal having an imaginary X axis along its length and an imaginary orthogonal Y axis along its width and an imaginary Z axis orthogonal to said X and said Y axis, said Z axis having a positive direction beginning at and extending from a front face of said sheet, and a negative direction beginning at and extending from a rear face of said sheet; and:

(a) forming at least two vanes connected to and extending away from at least one side of a central portion of said element, or on opposite sides of a central portion of said element, said central portion forming a support member, said vanes being separated from each other by a space; and (b) rotating said vanes relative to said support member so that each of said vanes has a positive Z axis direction component.

Preferably said vanes is a series of individual finger like vanes.

Preferably all of said vanes at least on one side of said support member are rotated to the same angle to the X axis.

Preferably all of said vanes, on one side of said support member are rotated to the same angle to the Y axis.

Preferably all of said vanes at least on one side of said support member are rotated to the same angle to the Z axis.

Preferably the method at step (b) also includes forming said vanes of a shorter length at one end of the length of said support member than the vanes at the other end of said support member.

Preferably vanes are formed on two sides of said support member and are a directed away from said support member so as to have at last some component of their direction in the positive direction of the Z axis.

Preferably all vanes on one side of said support member are substantially parallel to each other, when viewed from 2 orthogonal directions.

Preferably after said final step, said vanes are in an orientation such that each adjacent vane is either substantially collinear or parallel to each other vane along one side of said support member.

Preferably said support member is welded along its length to a flue for attachment to a fired water heater.

Preferably said steps of said method are formed by means of stamping and or pressing and or rolling processes, and or laser cutting.

The invention also provides a beat exchanger assembly including:

a tubular flue having an internal surface or surfaces about a passageway for gas flow; and a plurality of heat exchange elements spaced about the axis of the flue and fixed to said internal surface(s) so as to lie in said passage way;

wherein each of said beat exchange elements is elongate in a direction along the flue, has a base portion relatively wider than it is thicker adjacent to a complementary portion of said internal surface for transferring beat to the flue, and further having a vane or vanes arranged along the base portion and projecting from the base portion into the passage way.

Preferably said vane is a tab or/finger or said vanes are a plurality of similarly shaped tabs or fingers.

Preferably said tabs or fingers are spaced apart less than their width.

Preferably said tabs or fingers are in pairs with each pair being either convergent forwardly of divergent forwardly from the base portion.

Preferably said base portion has a rear face which is profiled or arcuate in transverse cross section, with vanes extending along radii of a circle which is defined by the inside diameter of said flue.

Preferably said vanes each include a portion which is a generally rectangular flat tab.

Preferably said tabs or fingers are in off-set parallel planes.

Preferably said tabs or fingers are at a predetermined angle to a plane bisecting the base portion along its longitudinal axis.

Preferably a baffle is located in said flue at an upstream end thereof, to direct exhaust gases through said heat exchange elements.

Preferably said baffle includes a cylinder closed at one end.

Preferably said baffle includes a flange at one end of said cylinder to support said end of said cylinder from the vane or vanes of said heat exchange element, with said cylinder extending in an upstream direction from the downstream-most end of said heat exchange element.

The invention further provides a water heater having a heat exchange assembly as described in any of the above paragraphs.

The advantage of the method embodiment of the invention is that a relatively quick and efficient method of manufacturing the vanes of a heat exchange element is provided. An advantage of the other embodiments is the provision of a surface for contacting the surface of a flue, which will produce a relatively high level of heat transfer to the flue to which the heat exchange element is connected, compared to other methods of contacting the two components, said element is constructed so that when said X axis is positioned substantially parallel to said longitudinal axis of said flue, said vane means is at substantially the same angle to said longitudinal axis of said flue as it is to said X axis.

BRIEF DESCRIPTION OF THE DRAWINGS

The present invention will now be described, by way of example only, with reference to the accompanying drawings in which.

DETAILED DESCRIPTION OF THE EMBODIMENTS

Figure 1:
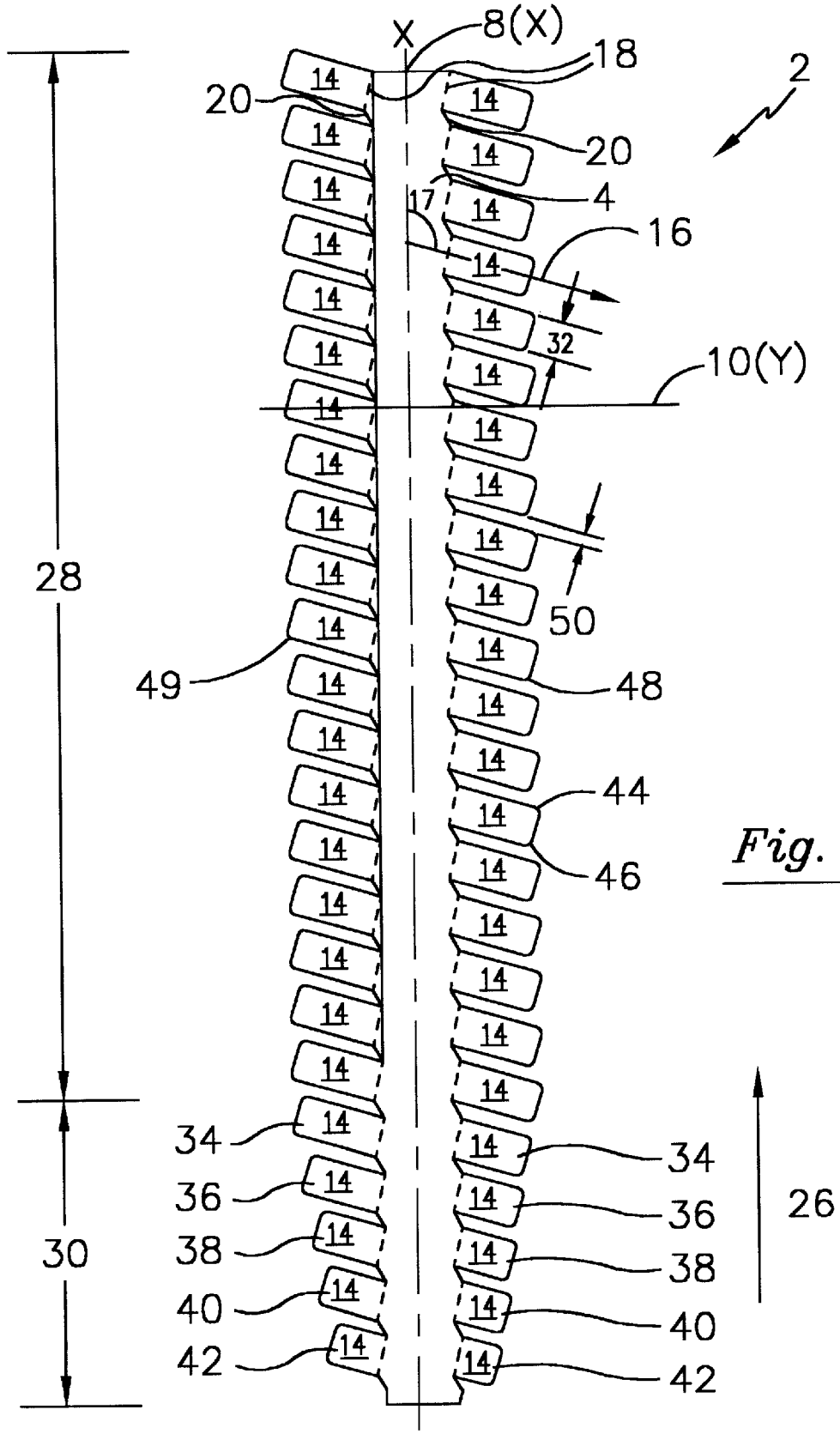
FIG. 1 illustrates a plan view of a first embodiment of the present invention.
Figure 3:
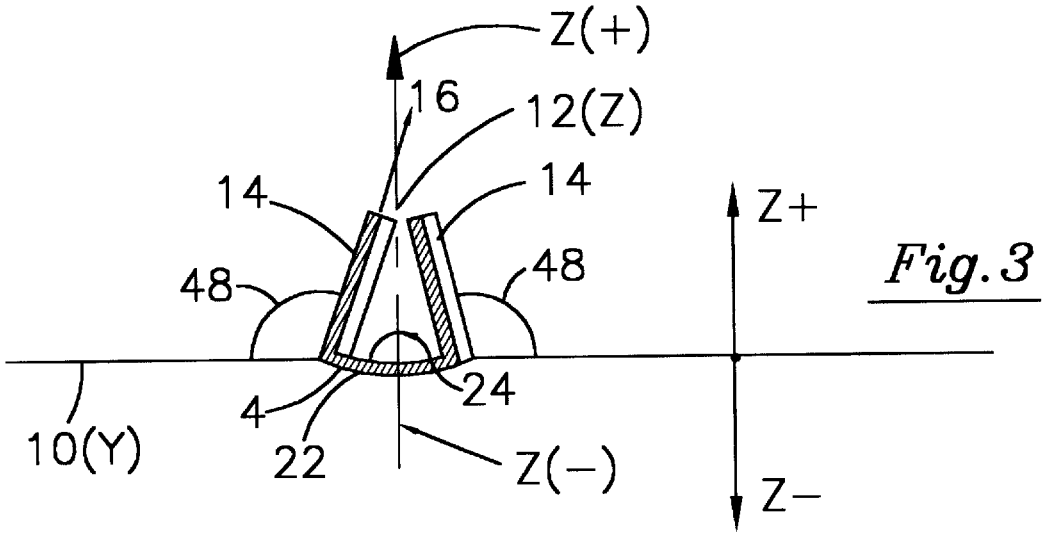
FIG. 3 illustrates a rear elevation of the apparatus of FIG. 1 when in a final condition.
Figure 2:
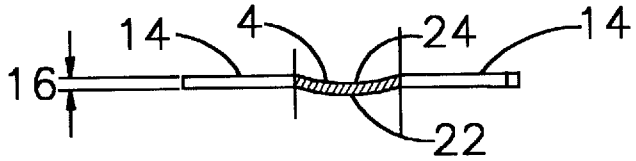
FIG. 2 illustrates a rear elevation of the apparatus of FIG. 1.

Illustrated in FIGS. 1 to 3 is a heat exchange element 2. In FIGS. 1 and 2 the heat exchange element 2 is illustrated after it has been formed by pressing or stamping from a generally planar sheet and before vanes 14 are rotated relative to a spine or support member 4. In FIG. 3 the heat exchange element 2 is illustrated after vanes 14 have been rotated.

The heat exchange element 2 is made up of the elongated support member or spine 4 which runs along the length of the heat exchange element 2. The width of the spine 4 is preferably greater than the thickness 6 (as illustrated in FIG. 2) of the material from which the heat exchange element 2 is manufactured. The spine 4 has a central longitudinal axis which represents an imaginary X axis 8. Illustrated in FIGS. 1 and 3 is an imaginary Y axis 10 and illustrated in FIG. 3 is an imaginary Z axis 12.

As illustrated in FIG. 3, the Z axis 12 has a positive direction above the Y axis 10 and a negative direction below the Y axis 10.

The periphery of the spine 4 illustrated by the combination of imaginary fold lines 18 and sides 20, is not represented as a straight line because the vanes 14 extend away at an angle 17 to the spine 4. The direction of extension of the vanes 14 is indicated by arrow 16.

Because of the angle 17 at which the vanes 14 extend away from the spine 4, a zigzag or sinusoidal pattern is formed by the imaginary fold lines 18 and the side 20 of the support member. It will be noticed that the width of the spine 4 measured parallel to the Y axis 10, along its length is substantially constant.

The spine 4 when initially formed is of a planar construction, however one of the manufacturing steps includes the formation of a convex, curved or contoured rear face 22 so as to enable the rear face 22 to be positioned in close proximity to the wall of the flue. The front face 24 and rear face 22 is most preferably arcuate, but the contour can be formed from a series of straight line bends so as to form a shape resembling an arc. In this embodiment, the front face 24 is parallel to the surface 22. However, the front face 24 is only preferably parallel to rear face 22, so that if desired, they need not be parallel. The rear face 22 has a contour to substantially match the internal diameter of a flue to which the heat exchange element 2 is to be attached. By the flue and support member contours substantially matching, the rear face 22 should produce a better rate of heat transfer or conduction through the spine 4 to the flue to which it attached, particularly by comparison to a relatively thin line or points of point contacts.

By the rear surface 22 having a contour which substantially matches the contour of the inside surface of a flue to which it will be attached, the element 2 will only be able to be positioned in one direction in the flue if the rear face 22 is to have maximum contact with the internal surface of the flue. That direction will be substantially parallel to a longitudinal direction of a straight portion of the flue.

If desired the rear surface 22 can have a contour which has a radius which is smaller than the radius of the internal surface of the flue. In this case the rear surface will not make full contact across its width with the inside surface of the flue. However, it can be close enough to have a good level of heat transfer. Even better heat transfer will result if when the element 2 and the inside surface of the flue are enamelled. If this happens the gaps between the rear surface 22 and the flue can be filled with enamel which will help to improve the heat transfer rate.

The contours and radius as described above, produce a rear surface 22 which is convex in the negative Z direction. However a contour or radius which produces a concave rear surface, relative to the negative Z direction, can also be formed. In this instance, the element 2 can have formed at the sides of the rear surface 22 two longitudinal bands of surface area by which the element 2 can be attached, be either welding one or both bands to the flue. In the case of a concave rear surface 22, enamel can be used to fill in any void or interstice between the rear surface 22 and the inside surface of the flue, so as to preferably have no air gap between the rear face 22 and the flue thus providing better heat transfer characteristics.

In the case where the flue is fluted or alternatively has a corrugated, wavy or sinusoidal circumference, the rear surface 22 can have the same profile so as to have the two profiles match as substantially as possible, or alternatively any gaps can be filled with enamel.

When relatively thin sheet metal is used to manufacture the heat exchanger element 2, the formation of a curved rear surface 22 and correspondingly curved front face 24 is a means of providing some structural rigidity to the spine 4, thereby helping it to maintain a relatively straight line X axis 8. However, if for some reason the flue is required to go through an angular bend, or have a radius in its longitudinal axis, then the X axis 8 of heat exchange element 2 can also be given the same bend or radius. In such case it may be necessary to modify the shape of the vanes 14 in the radius so as to maintain an air gap between the vanes, as the space between adjacent vanes will no longer be parallel sided, but tapered.

Figure 5:
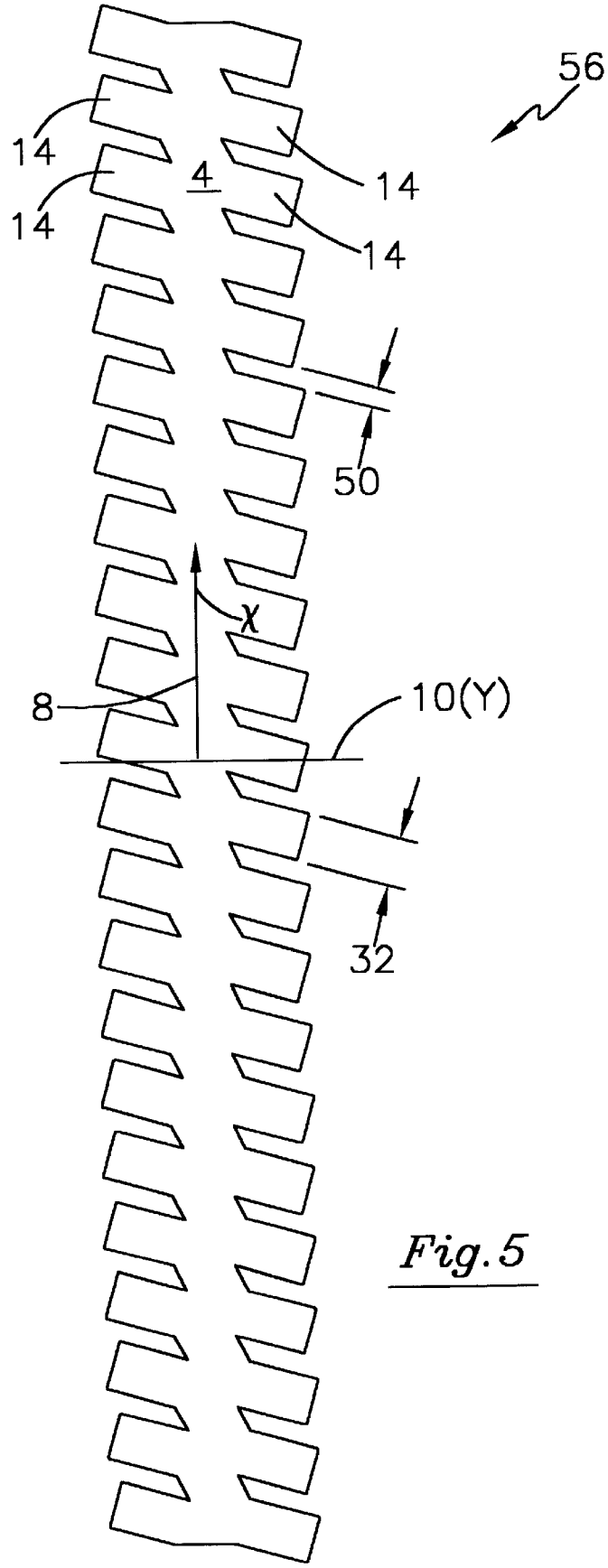
FIG. 5 illustrates a plan view of another embodiment of the present invention.

The vanes 14, when initially formed by stamping, as in FIG. 1 or 5, extend in the direction of arrow 16 from the spine 4. Angle 17 is of the order of 105° measured in the clockwise direction from the X axis 8. This angle 17 positions the vanes 14, when folded along the fold lines 18, to the positions as illustrated in FIG. 3, being at an angle 19 of approximately 15° to the X axis 8 measured in the clockwise direction. (See FIG. 6 for a representation of angle 19.) This angle 19 of 15° will mean that any hot gases which flow in the direction of the length of the heat exchange element 2, in the direction of arrow 26, will be given a velocity component in the Y axis 10 direction as well as a reduced velocity in the direction of row 26, thus making the gases begin to move in a helical path to the outlet of the flue in which the heat exchange element 2 is positioned.

In FIG. 1 the vane 14, located in region 28 of the heat exchange element 2, are all of substantially the same length and width and thus surface area. However in the region 30 the vanes 14 have a reduced surface area which is produced by a reduced length of the vane in the direction of extension. The width 32 of the vanes in the area 30 remains substantially the same. It will be noticed that in the region 30 the pair of vanes on eider side of the spine 4 being pairs 34 36, 38,40 and 42 are each of a length which progressively diminishes from the pair of vanes 34 through to the pair of vanes 42. The length of the vanes 14 is preferably reduced, at its smallest length to approximately 30% of the regular length. More will be said about this feature later.

Figure 11:
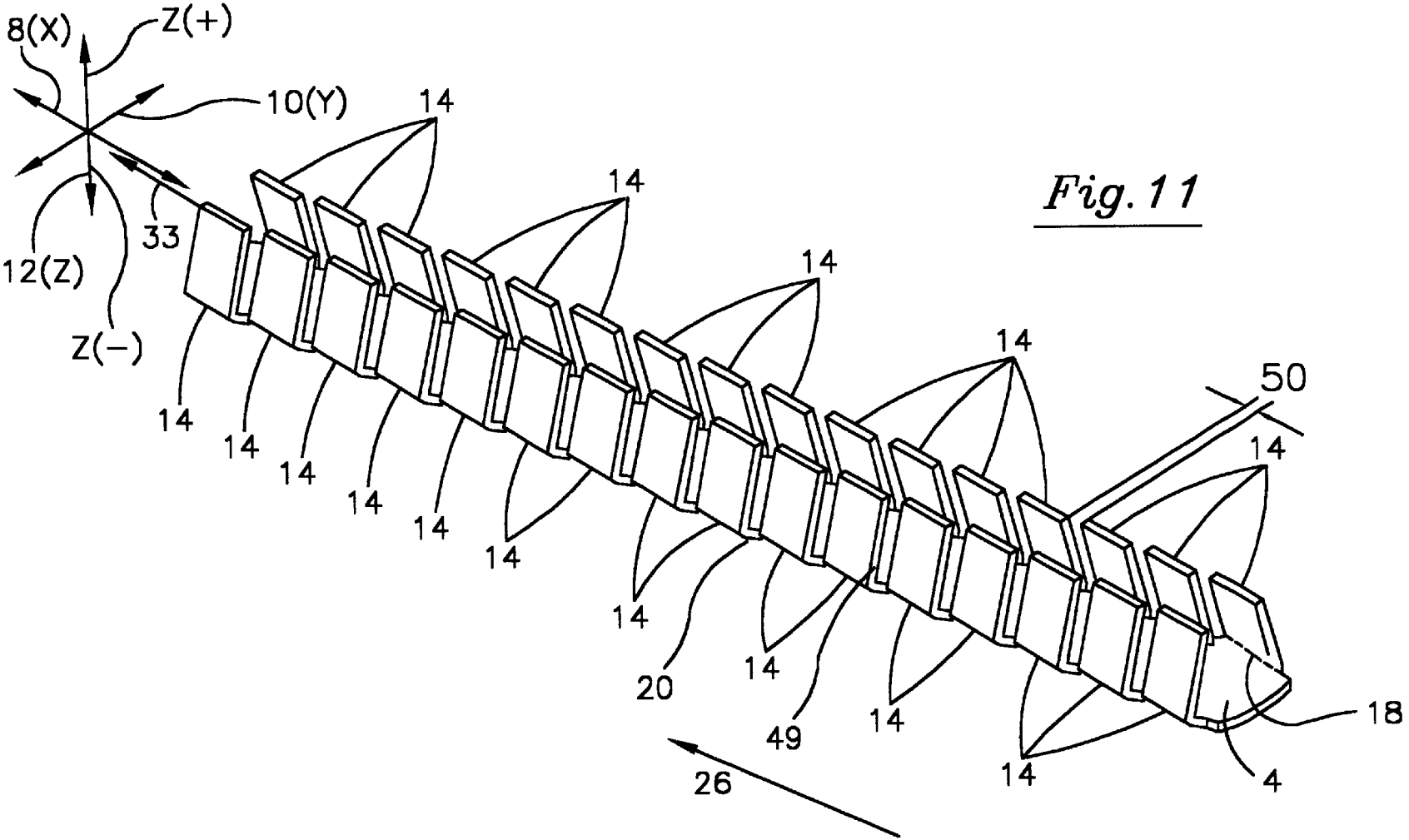
FIG. 11 illustrates a perspective view of a fourth embodiment of the invention where the end of vanes are substantially parallel.

In FIG. 1, all the vanes 14 are of a substantially rectangular construction, with the corners 44 and 46 of each vane including a radius. This helps to reduce back pressure production when in use, by providing a more streamlined flow path. The downstream or leading edge 49 of each vane, in this embodiment is a flat edge face (which is the thickness of the sheet metal) which is square to the two rectangular surfaces of each vane. (The leading edge 49 is better illustrated in FIGS. 6 and 11). By the leading edge 49 being a flat and almost being at right angles to the direct of exhaust gas flow, some resistance is produced in the path of air flowing in the direction of arrow 26, when these vanes 14 are folded and in the position illustrated in FIG. 4 and 5. This resistance can be reduced by shaping these leading edges 49, for example, with a bevel or double bevel or even an aerofoil shape.

Figure 4A:
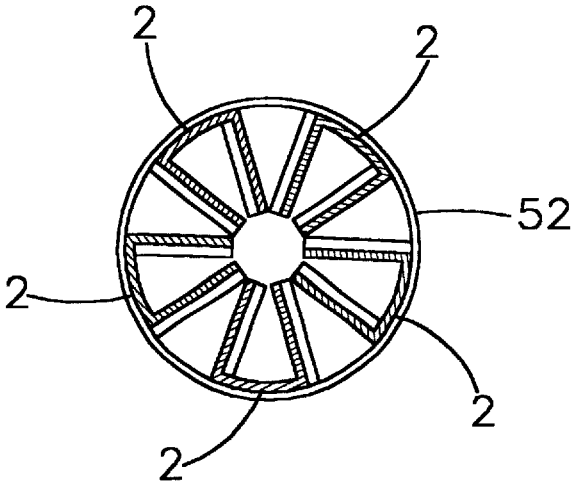
FIG. 4A illustrates a plan view through the flue showing five heat exchange elements of FIG. 1 in position.

From the generally planar first stage of forming of the heat exchanger element 2 as illustrated in FIG. 1, each vane is rotated some 98° to 105° as indicated by angle 48 (illustrated in FIG. 3). The actual size of angle 48 will depend upon many factors. One factor is if five heat exchange elements are going to be utilised in a flue of 4 inch (100 mm) diameter as illustrated in FIG. 4A, the angle 48 is preferably of approximately 105°. Whereas if only four such heat exchange elements were used then an angle 48 of 98° could be utilised. If desired, depending upon how many heat exchange units were utilised, the angle 48 can vary from a relatively small angle to the Y axis 10 (to take account of the contour of the flue) to an angle whereby the end extremity of the vanes 14 on opposite sides of the spine 4 make contact together in the inner portion. Alternatively, one side could adopt one angle and the other side could adopt a different angle or each vane 14 could be at a different angle to each adjacent vane 14 or each other vane 14.

Whilst any angle can be utilised the best results arise when the angle is selected so that the vanes 14 will extend as far as possible in the direction of the positive Z axis 12. The reason for this is that in an exhaust flue of a gas or oil fire system, the exhaust gases at the centre of the flue are generally hotter than those at the sides and by being closer to hotter gases, the heat exchange element gains access to a greater heat intensity.

Between each vanes 14, both when initially formed and when rotated to the positions of FIG. 3, there is located a space 50. This width of the space 50 is decided from a balance of several factors. If it is too close the heat exchange element 2 will operate at a higher conductive level or higher rate of heat transfer to the flue, but the amount of back pressure produced may choke the combustion chamber if natural draft is used. However if the gap is too great this will cause a decrease in the heat transfer rate or conductivity of the heat exchanger element but will have relatively low back pressure production.

For systems which would be used with forced draft or fan assisted draft system the space 50 can be reduced almost to the point of contact or a very thin space 50, because the amount of back pressure which may be created can be overcome by the fan or forced draft.

Preferably the space 50 is of the range of 30% to 45% of the width of the vane. In the element 2 illustrated in FIG. 1 if the width of the vane is approximately 20 mm the space 50 can be of a width of 8 mm.

Figure 17:
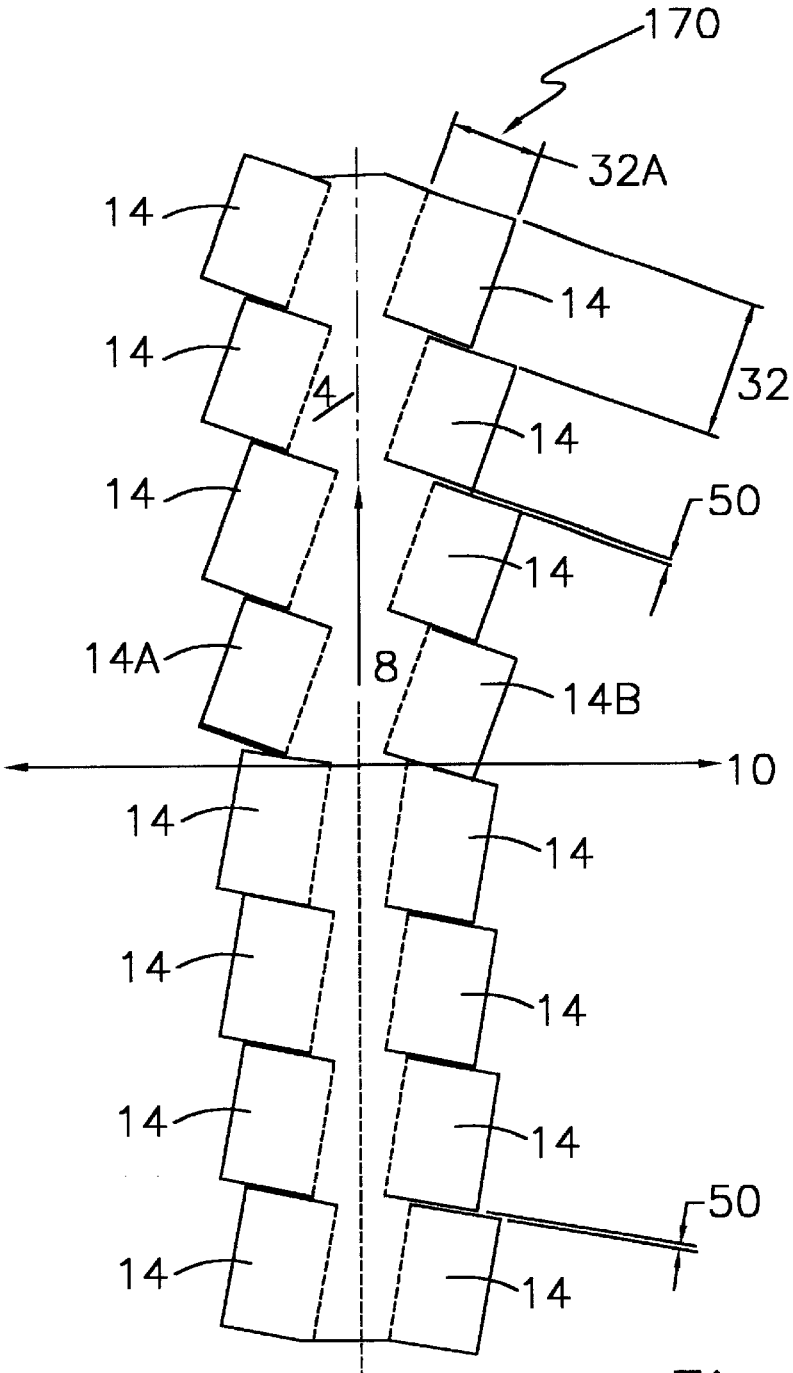
FIG. 17 illustrates a plan view of a heat exchange element prior to folding to produce a heat exchange element.

Illustrated in FIG. 17 is a heat exchange element 170 prior to the folding of vanes 14. In FIG. 17, like parts with the other figures have been like numbered. In this embodiment, the length 32A of the vanes 14 is less than the width 32 of the vanes 14. By making the vanes 14 with a length 32A longer than the width 32, it has been found that the space 50 between adjacent vanes 14, prior to folding can be very small. In the case of the element 170, the space 50 can be formed by a shearing process, that is no metal is actually removed.

It will be noted from FIG. 17 that the group of eight vanes 14 below Y axis 10 art all at the same angle to the support member 4 or the X axis 8 (prior to bending the vanes). Whereas the group above the Y axis 10 in FIG. 17, are all at the same larger angle to the support member 4 or X axis 8, prior to bending the vanes 14. The change over from bottom group to top group, because of the different angle, the vanes 14A and 14B have a different or truncated shape by comparison to the rest of the vanes 14.

Figure 18:
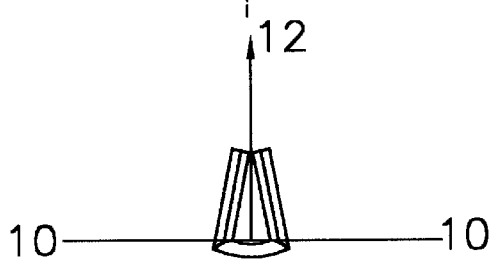
FIG. 18 illustrates a plan view of an element formed from the apparatus of FIG. 17.

The heat exchange element 170, when the vanes are folded, as illustrated in end elevation of FIG. 18 has a similar appearance to the previous embodiments except that instead of a curved spine 4, the spine 4 has a chevron cross section or appearance.

Figure 19:
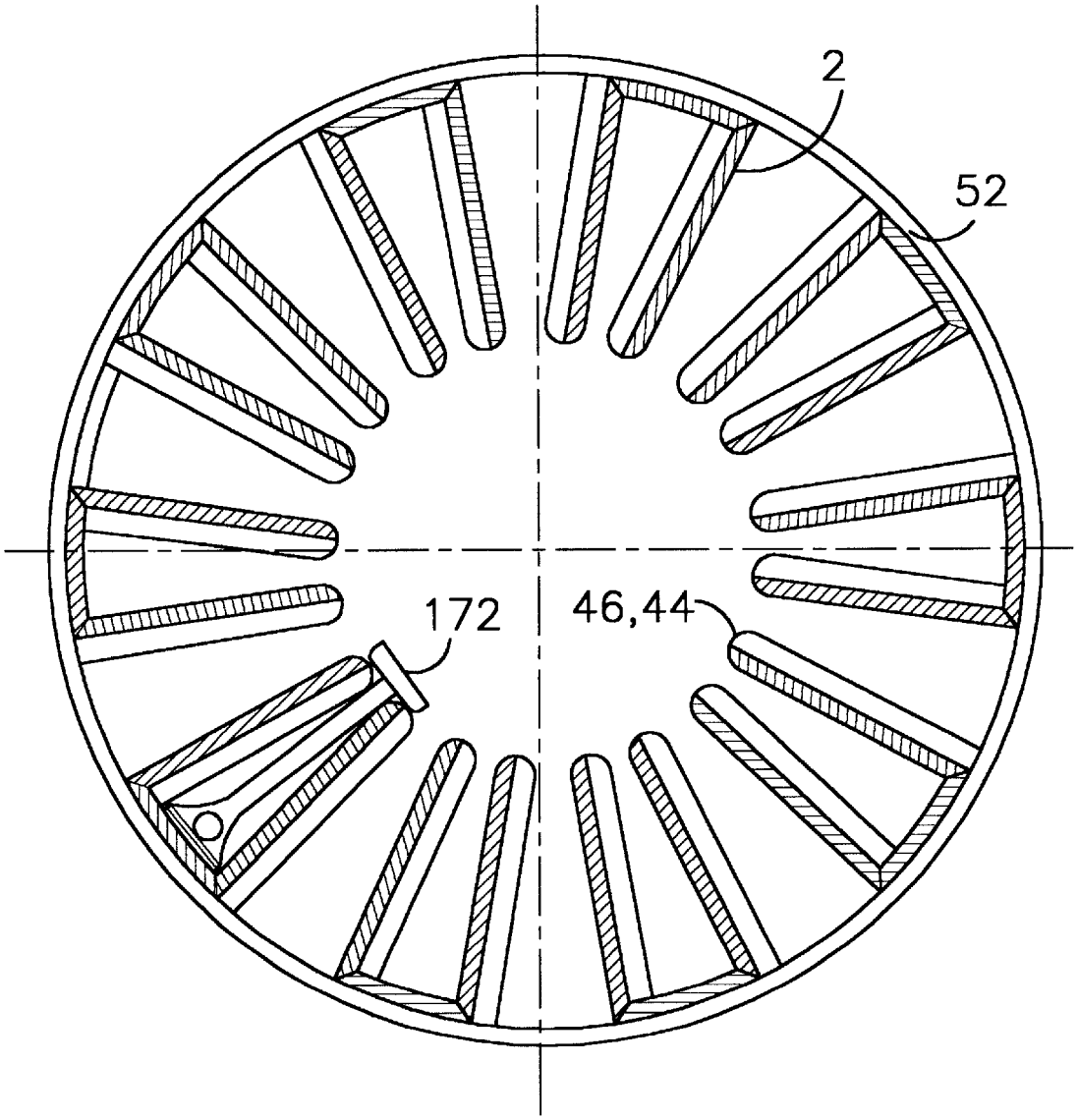
FIG. 19 illustrates a cross section through a 200 mm flue.

The size of the flue into which the heat exchange element 2 will be inserted will also dictate the length of the vane in the direction of arrow 16. For a flue of a diameter of 4 inches (100 mm) the vane 14 will be of approximately 30 mm in length and some 20 mm in width whereas for an 8 inch diameter flue (as illustrated in FIG. 19) the length will be approximately 50 mm in length and the same 20 mm width. In both instances the space 50 can be approximately the same, ie 8 mm.

Figure 4:
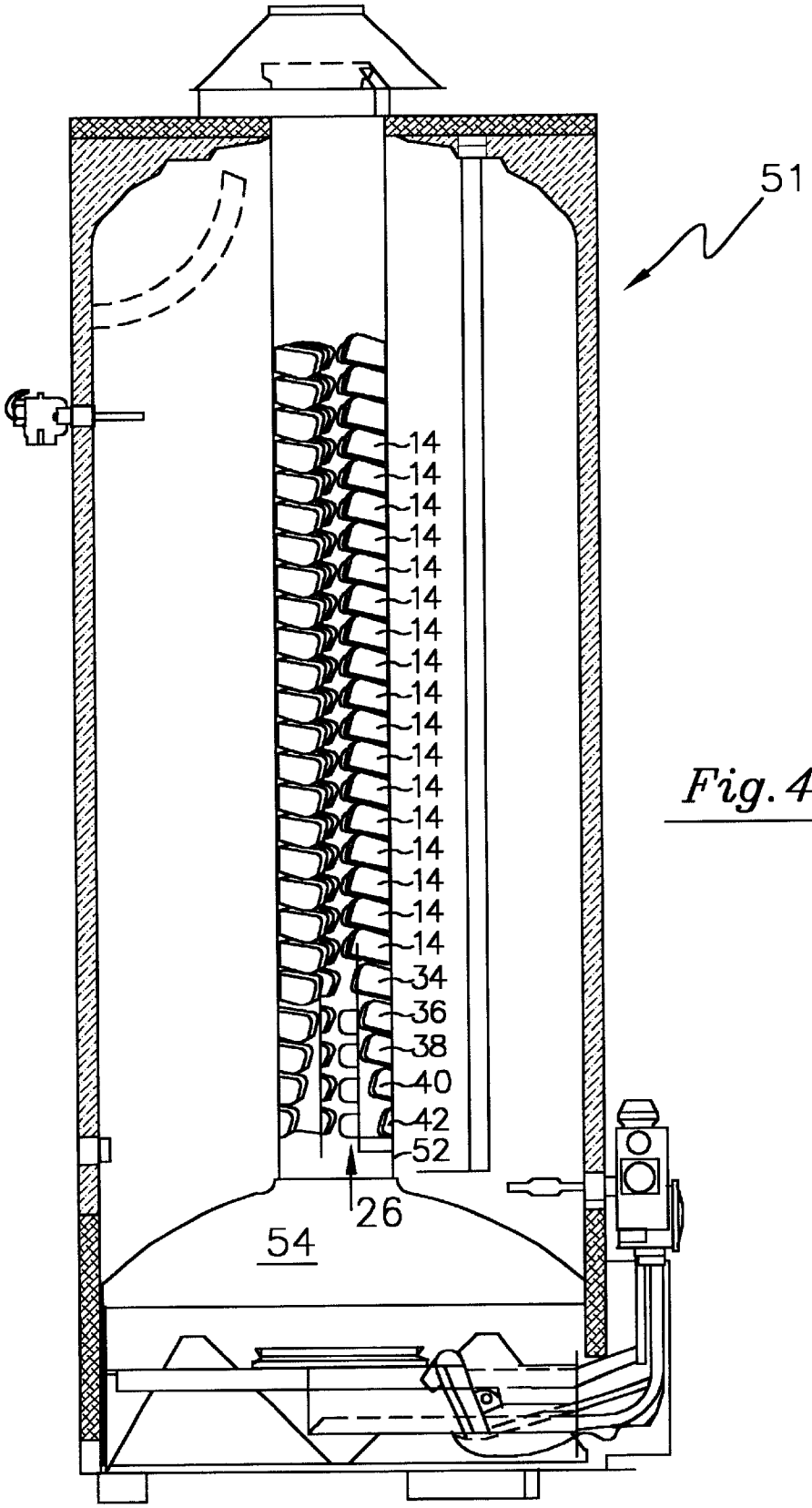
FIG. 4 illustrates the apparatus of FIG. 1 installed into a flue of a gas water heater.

As illustrated in FIG. 4 a water heater 51 has centrally positioned flue 52. At the lower end of the flue 52, closest to a combustion chamber 54, the respective pairs of vanes 42, 40, 38, 36 and 34 progressively increase in length in the direction of arrow 26 which is the upstream direction of the flue 52. The element 2 is manufactured in this manner so as to reduce the amount of heat (by reducing the surface area of the respective vanes) that the vanes 42 to 34 will absorb. This will help to reduce the amount of oxidation and reduce the deterioration of any enamel coating that may be placed over the heat exchange element 2 and the internal portions of the flue 52. The enamel is used to protect the vanes 14 and the flue against corrosion and oxidation. By not making the vanes 42 to 34 the same length as the others in region 28, the life of the whole flue system may last longer. This is because the initial deterioration or oxidation of the lower vanes, 42 to 34 should take longer to occur.

Another advantage of decreasing the size of the vanes as they approach the combustion chamber is that the level of back pressure produced by the vanes at the base of the flue will be less than downstream end of the flue. For a 4 inch flue the progressively increasing size of the vanes 14 can occur over some five rows or five pairs of vanes. However it may also occur over some ten rows or pairs of vanes on the heat exchange elements, particularly if larger diameter flues are involved. If higher temperature gases are involved a greater tapering distance could be desired for example along the first half of the length of the heat exchange element.

Illustrated in FIG. 5 is heat exchange element 56 of a second embodiment of the present invention which is different to that of the embodiment of FIG. 1. In this embodiment the vanes have: a relatively shorter length; the corners 44 and 46 are not rounded; the central spine 4 is generally the same as that of FIG. 1, however the imaginary fold lines 18 are not illustrated. It will be noted for this embodiment that the heat exchange element 56 does not have its vanes progressively decreasing in length. If such vanes are desired, they can be produced by shortening the vanes at one end of the support member.

Figure 6:
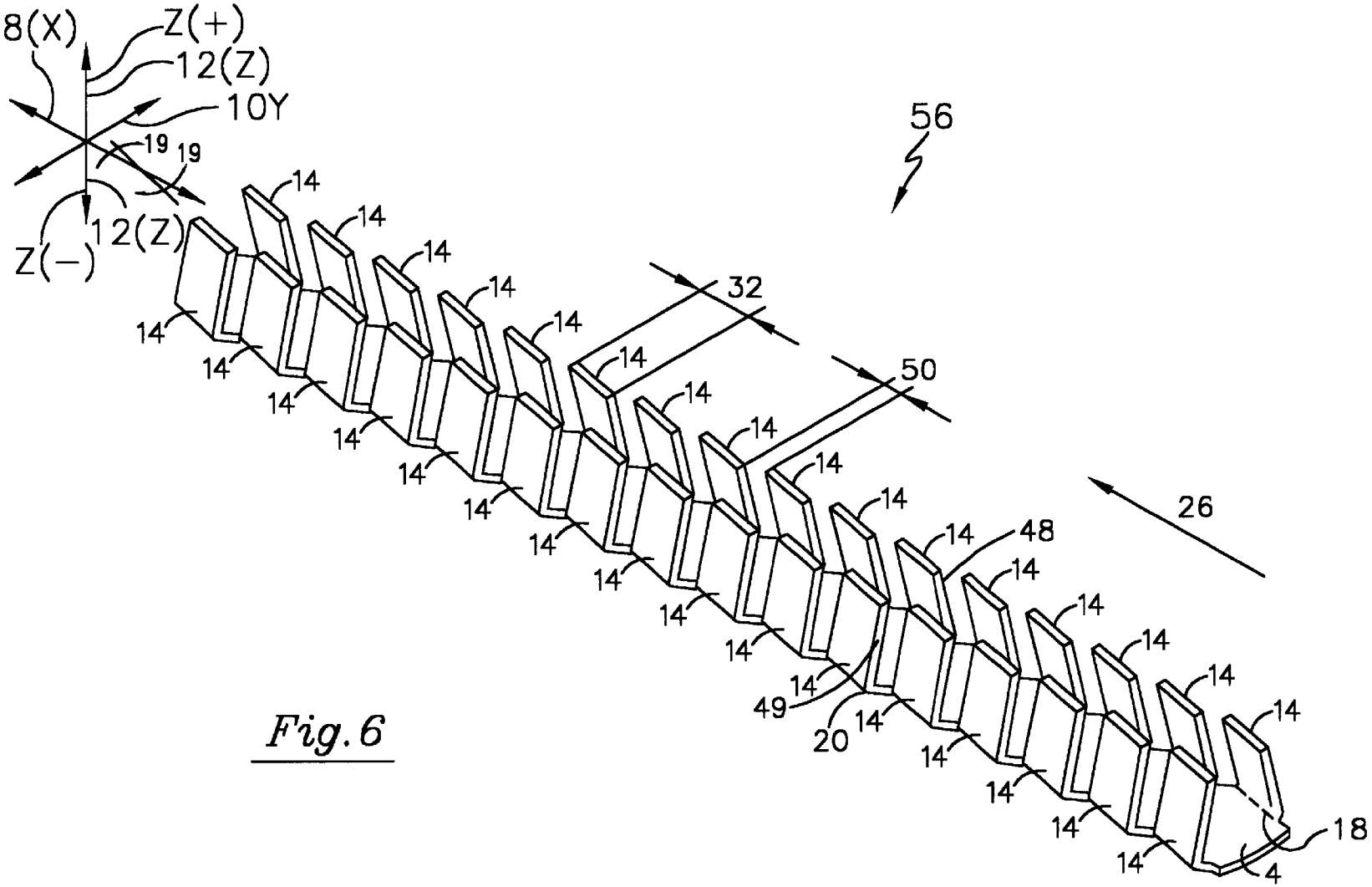
FIG. 6 illustrates a perspective view of the apparatus of FIG. 3 when folded into final form.

When folded or bent into position, the vanes 14 of FIG. 5 are folded to the same angle 48 of FIG. 3, that is preferably in the range of 98° to 105°, depending upon the number of heat exchange elements 56 used or the size of the flue into which the heat exchange element 56 will be inserted. FIG. 6 illustrates a perspective view of a fully formed heat exchange element 56, with the vanes 14 rotated relative to the support member 14.

Figure 9:
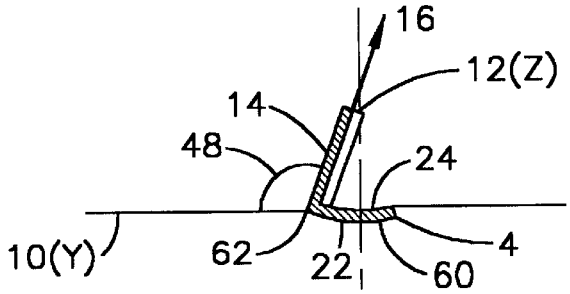
FIG. 9 illustrates a rear elevation of the apparatus of FIG. 7 when in final form.
Figure 8:
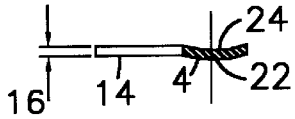
FIG. 8 illustrates a rear elevation of the apparatus of FIG. 7.
Figure 7:
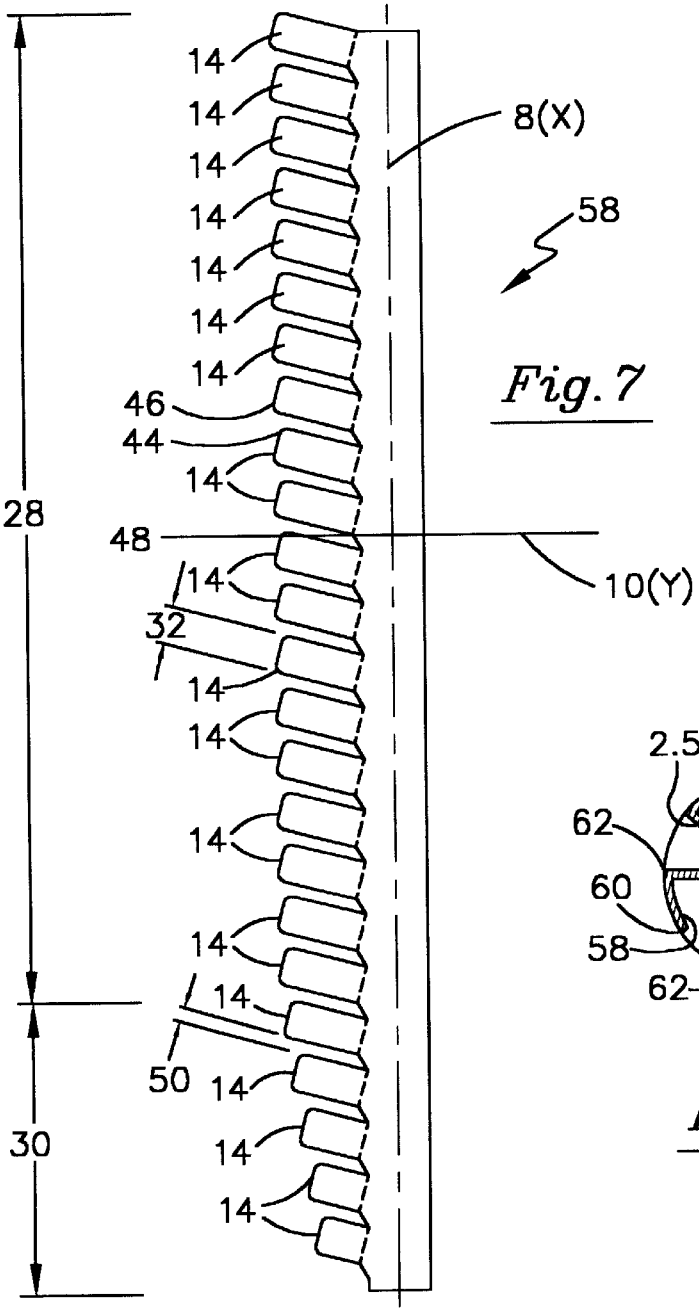
FIG. 7 illustrates a third embodiment of the invention in plan view.
Figure 10:
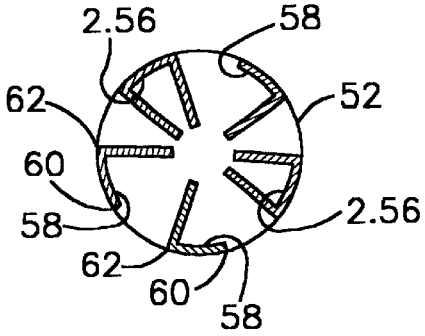
FIG. 10 illustrates a plan view of the apparatus of FIG. 9 installed into a flue in combination with the apparatus of FIG. 1.

Illustrated in FIGS. 7, 8 and 9 is a heat exchange element 58 similar to that of FIG. 1, except that the vanes are formed only on one side of the spine 4. Like parts in FIGS. 7, 8 and are like numbered to corresponding parts in FIG. 1. When assembling the heat exchange elements 58 into a flue, they can be assembled so that the end 60 of one spine 4 is spaced relative to the other end 62 of an adjacent spine 4. The heat exchange element of FIGS. 7 to 9 can be utilised in water heaters where the combustion system is very sensitive to back pressure. By reducing the numbers of vanes by half, less back pressure will result from each element 58 utilised. If desired a combination of two or more of elements, 2, 56 and or 58 can be used as is also illustrated in FIG. 10.

When installing any of the heat exchange elements 2, 56, 58 (described above) into a flue, a weld of approximately 3 to 5 mm in width, down the centre of the spine 4, along its whole length, is desired. This will help maximise heat transfer, but will also be relatively easy to apply an enamel coating to. Preferably the welding is done on the side of the flue opposite to the side against which a heat exchange element 2, 57 or 58 will be located.

Modifications to the heat exchange elements mentioned above can be made. For example, instead of the vanes 14 being at an angle of some 15° to X axis 8 they could be parallel or substantially parallel to the X axis 8 as is indicated in illustrated in FIG. 11, by the direction 33 of the width of the vanes 14 being substantially parallel to the X axis 8. This would orient all the vanes so that they were substantially collinear to each other on each side of the support member 2, rather than parallel but not collinear as is the case with the embodiment of FIGS. 1 to 10. Whilst no swirling or helical motion of exhaust gases will occur, the vanes and support member will act as a heat exchange, and they will absorb heat and transfer it to the flue.

Other size angles to the X axis 8 can be utilised. The angle 19 of FIG. 6 at 15° has been selected for use with natural draft system and it is expected that the angle 19 can range between approximately 10° and approximately 20° and still be able to be utilised with natural draft systems. It is expected that above 20°, depending upon other factors and characteristics of the combustion system, it may be required to have some forced or fan assistance. If fan assistance is present, the angle 19 at which the vans 14 lie to the X axis 8, could vary from between approximately 20° and approximately 35°.

In flues which do not have heat exchange vanes, where it is desired to extract 50 MJ of energy from the exhaust fumes and the flue is of a 4 inch diameter, a length of approximately 1.8 metres of flue would be required to extract that energy. Whereas with the heat exchange elements of the embodiments of FIGS. 1 to 6, 11, and 13 to 18 described above having two sides of vanes, to extract 50 MJ from a 4 inch flue, a length of approximately 0.9 metres of flue would be required. The heat exchange element of embodiments of the present invention having two sides with vanes, provides a relatively quick and easy mechanism to manufacture a vaned or finned flue particularly by comparison with the prior art wherein each vane was individually welded to the flue.

When manufacturing any of the above described elements, preferably the finger like vanes 14 are stamped from a piece of sheet metal, thus simultaneously forming the spine 4. Simultaneously or sequentially the curve of rear surface 22 can also be formed. The next step is to rotate the vanes 14 so as to place them at angle 48, as designed, to the Y-axis 10.

Figure 12:
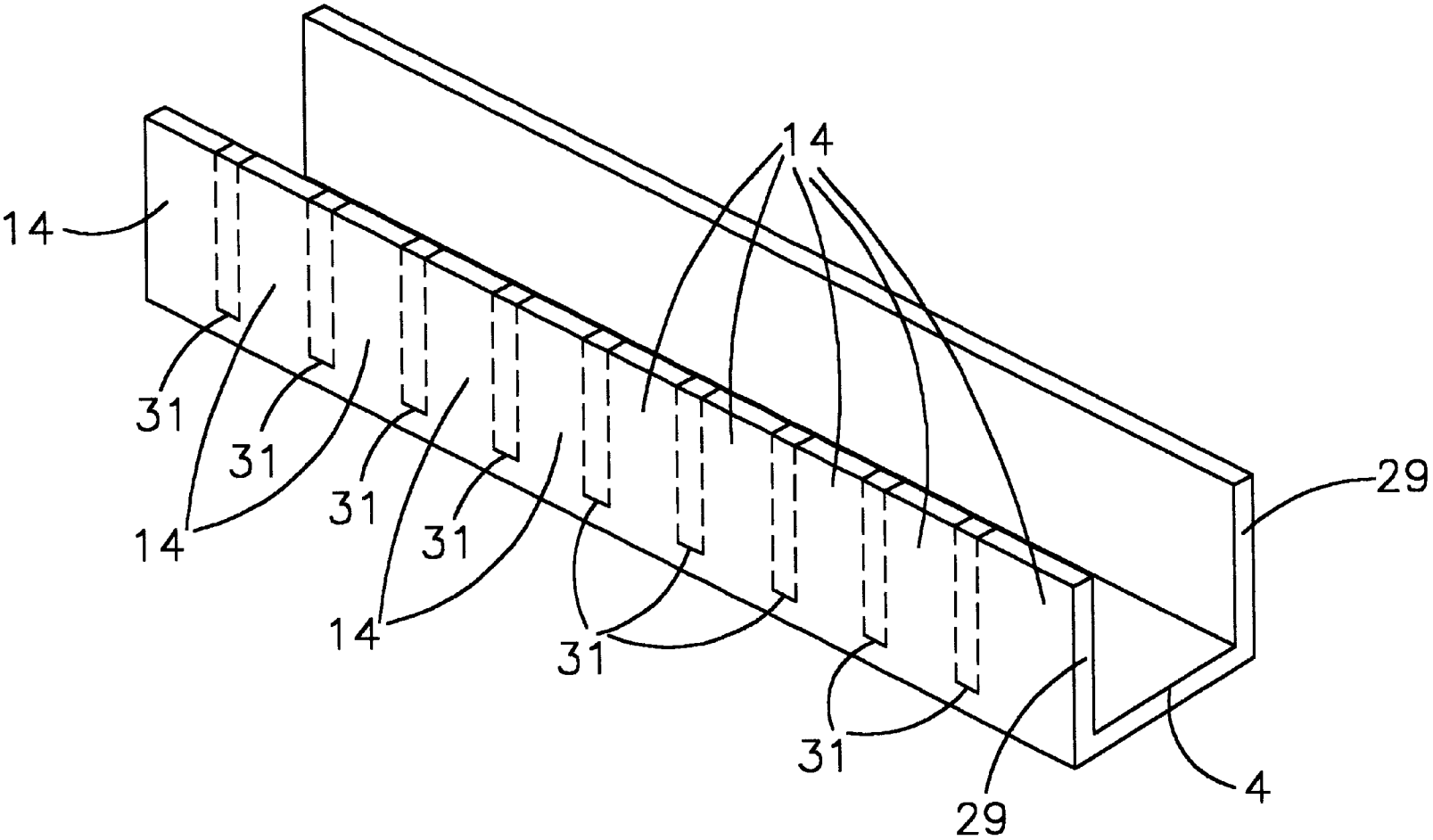
FIG. 12 illustrates the formation of a heat exchange element from an L-shaped or channel member.

The heat exchange elements 2, 58 and 56 could alternatively be manufactured from channel sections of U or C or J shapes or from angle sections such as L shape. As illustrated in FIG. 12, if manufactured from a channel section the middle portion can act as the spine 4. The sides 29 and 29' can have the vanes formed in them by laser cutting the vanes 14 in the sides along the lines 31. The vanes 14 can then be bent to any desired position and rotated if necessary so as to be at an angle (see angle 19 of FIG. 6) to the X axis 8. In which case, a portion of the vane will have a part helical construction.

If desired the side walls 29 and 29' can be formed at the desired angle to the spine 4 before laser cutting occurs.

In FIG. 12 only one side 29' is indicated as having vanes 14 formed therein. The other side 29 may have vanes 14 formed sequentially or simultaneously to side 29'. However, if desired, a combination of angled vanes and one single straight line vane 29' on the other side could be utilised.

If an L shaped section were to have vanes 14 formed therein, process would be similar to that described above, but of course there would only be one side wall 29' extending from the spine 4.

If no rotation is given to the vanes 14 of FIG. 12, the vanes will be aligned and parallel to the X axis 8.

Gases which are exhausted in a combustion chamber generally have a very large volume and is volume gradually decreases as the exhaust gases move up a flue and as the heat is transferred out of them. To accommodate this characteristic the following embodiments provide features which allow a hot water system having a heat exchange element combined with the heater flue to operate more effectively.

Figure 13:
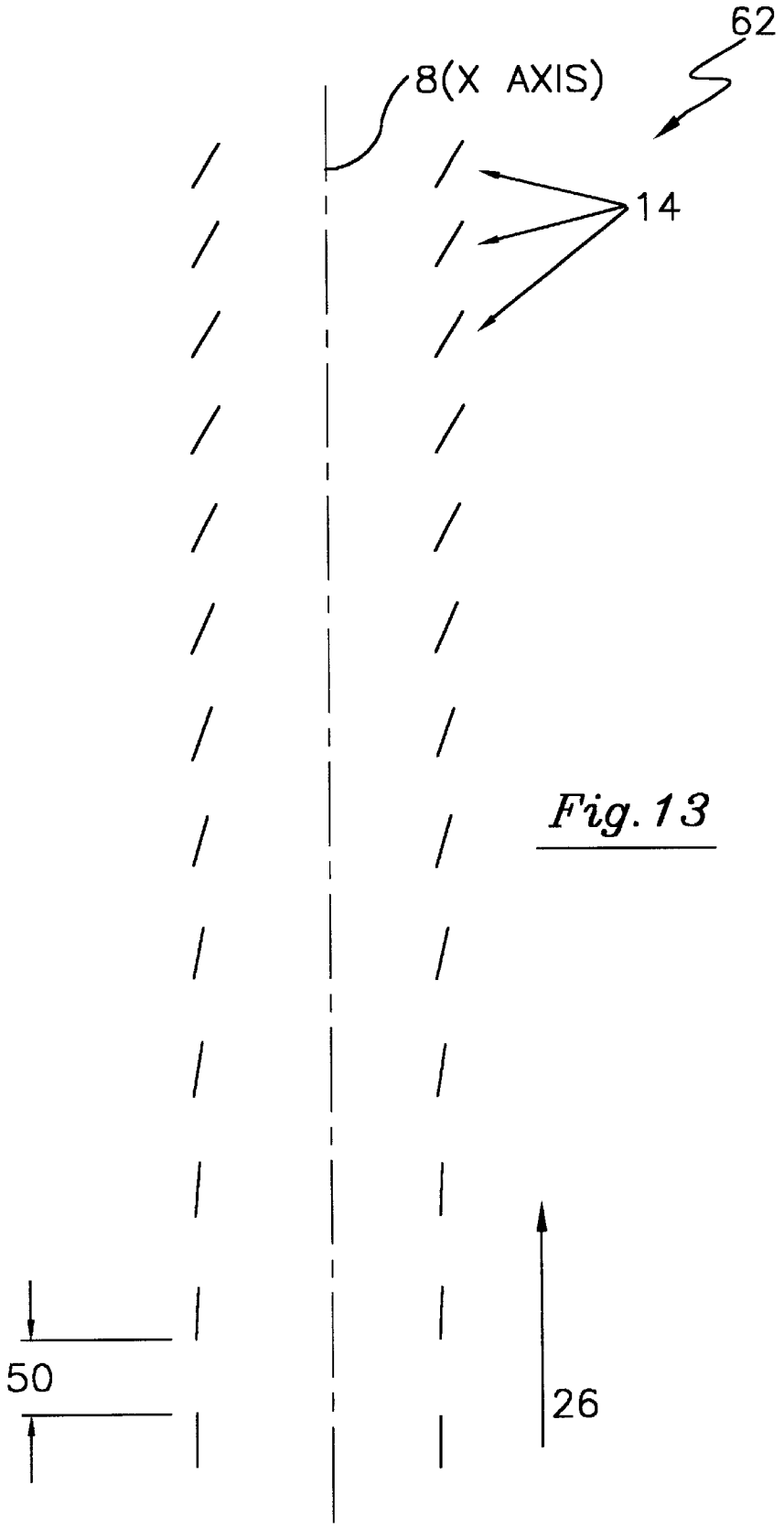
FIG. 13 illustrates a schematic plan view of a formed heat exchange element having vanes at different angles to the X axis.

Illustrated in FIG. 13 is a schematic plan view of the vanes of another embodiment of the invention. The heat exchange element 62 of FIG. 13 is manufactured by any one of the above described methods. The element 62 differs from the other embodiments in that each of the vanes 14 starting at the bottom of FIG. 13, are at progressively increasing angles (corresponding to angle 14 of FIG. 6) to the X axis 8. It will also be noticed that the spacing 50 between adjacent vanes 14 is approximately equal.

If desired each vane 14 need not be at a different angle to adjacent vanes. Rather, the vanes can be divided up into groups of adjacent elements (with for example 3 to 5 or any appropriate number of vanes in each group), with the vanes in each group of elements having the same angle corresponding to angle 14 of FIG. 6) to the X axis 8 as the other vanes in the same group. Whereas the angle to the X axis 8 for each group of vanes may vary from group to group. Preferably variation in angle is such that the group at one end of the element 62 is at the smallest angle, say in the range of between 0 degrees to 5 degrees to the X axis 8, and the angle progressively increases in adjacent groups, for example up to between 35 degrees 45 degrees to the X axis 8 in a forced draft situation, or between 20 to 25 in a natural draft situation.

By installing the heat exchange element 62 of FIG. 13 in a flue so that the minimum angled vanes, or group of vanes, is closest to the combustion chamber of a water heater, and because of the varying of the angle from minimum to maximum, a more efficient energy extraction system can be produced. This is because the high volume, high temperature exhaust gases can have their flow path influenced by relatively small angles. The element 62 also provides a minimum of obstruction at the end of the heat exchange element closest to the combustion chamber. Whereas when the volume and temperature have decreased, a greater angle is required to influence the flow.

Figure 14:
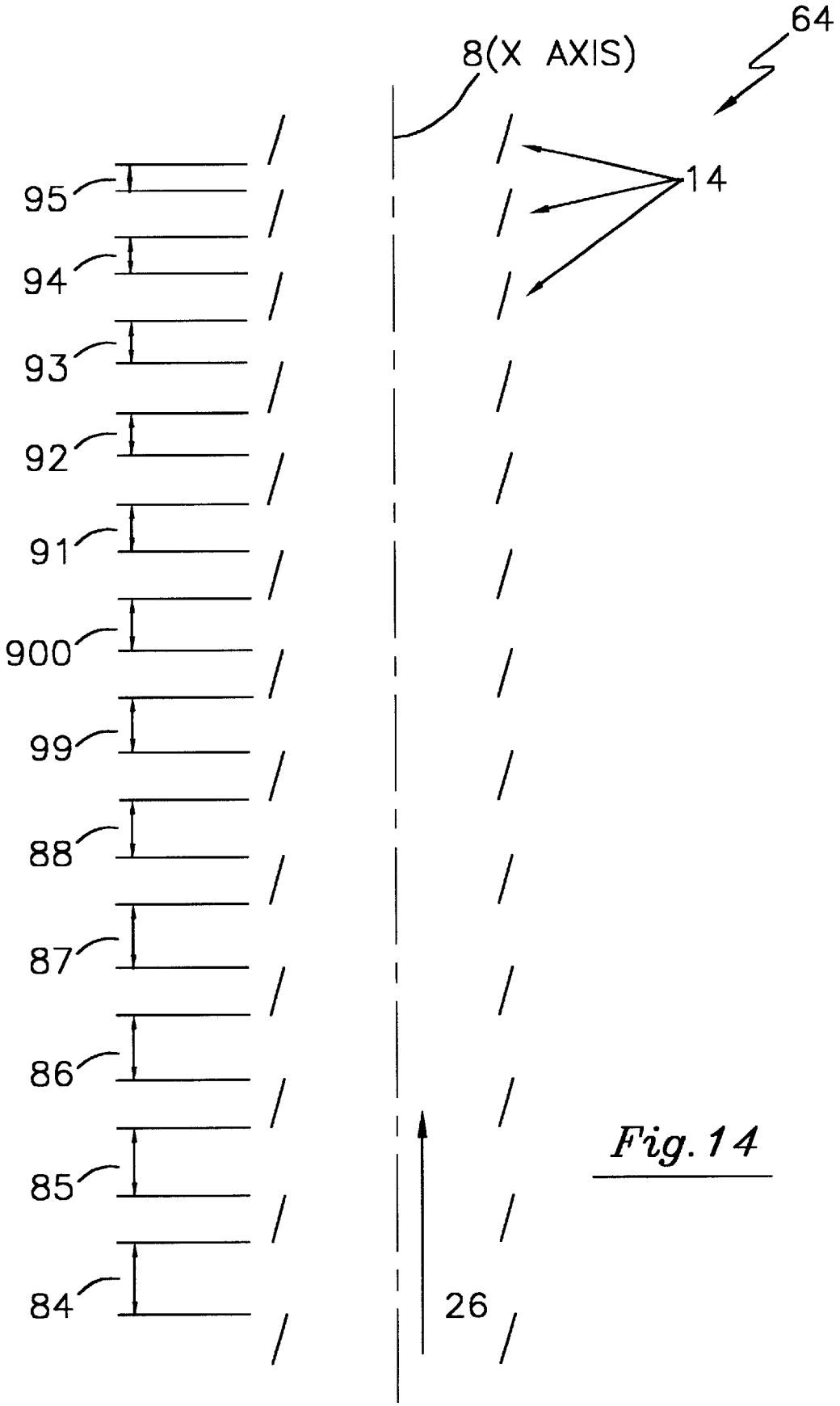
FIG. 14 illustrates a schematic plan view of a formed heat exchange element having vanes at the same angle with different sized spaces between vanes.

Illustrated in FIG. 14 is a schematic plan view of the vanes of another heat exchange element 64. This element 64 has each of the vanes 14 at the same angle (corresponding to angle 19 of FIG. 6) to the X as 8, however it will be noticed that the spaces 84 to 95 each have a different dimension.

Figure 15:
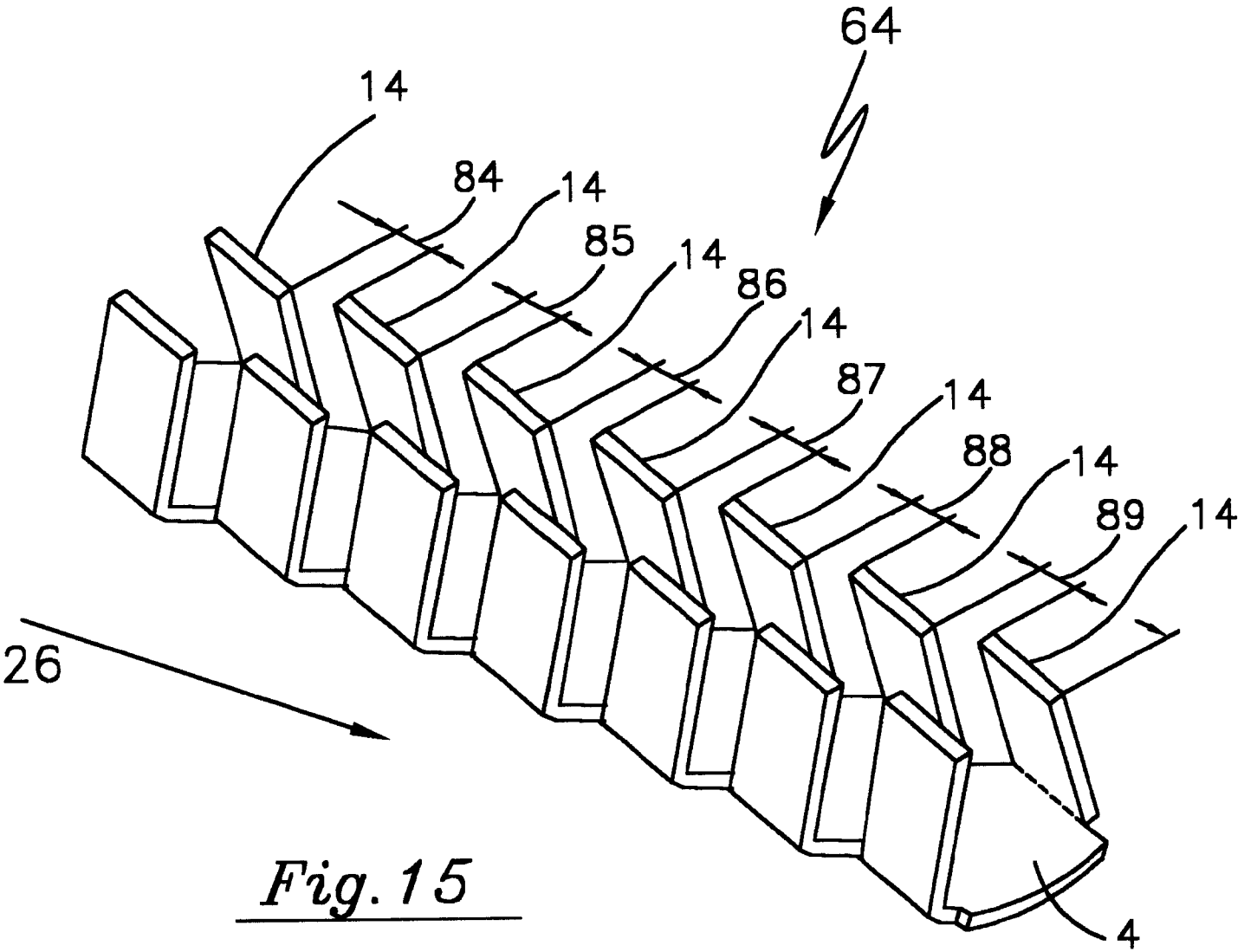
FIG. 15 illustrates a perspective view of a part of a heat exchanger which has different spacing between adjacent vanes.

Illustrated in FIG. 15 is a perspective view of a part of the element 64 of FIG. 14 showing a decreasing dimension of the spacings 84 to 89 in the direction of the arrow 26 which is the direction of flow of the exhaust gases exiting a combustion chamber to the downstream end of the flue.

If desired the dimension of spacing 84 need not be of a different dimension to spacing 85, or 85 to 86 and so on. Rather, the spacings can be divided up into groups of adjacent spacings, with the spacings in each group having the width as other spacings in the group. Whereas the dimension for the spacings of each group may vary from group to group. Preferably variation of the dimension of the spacings is such that the group at one end of the element 64 is at the smallest dimension and the dimension progressively increases in adjacent groups.

By installing the heat exchange element 64 so that the larger spaces 26 are in the upstream end of the flue closest to the combustion chamber, then because there are larger spaces, less obstruction and back pressure production will result, particularly when the gases are in a high temperature high volume condition, whereby any obstruction will produce a greater back pressure, than when the gases are at a lower temperature and lower volume.

Figure 16:
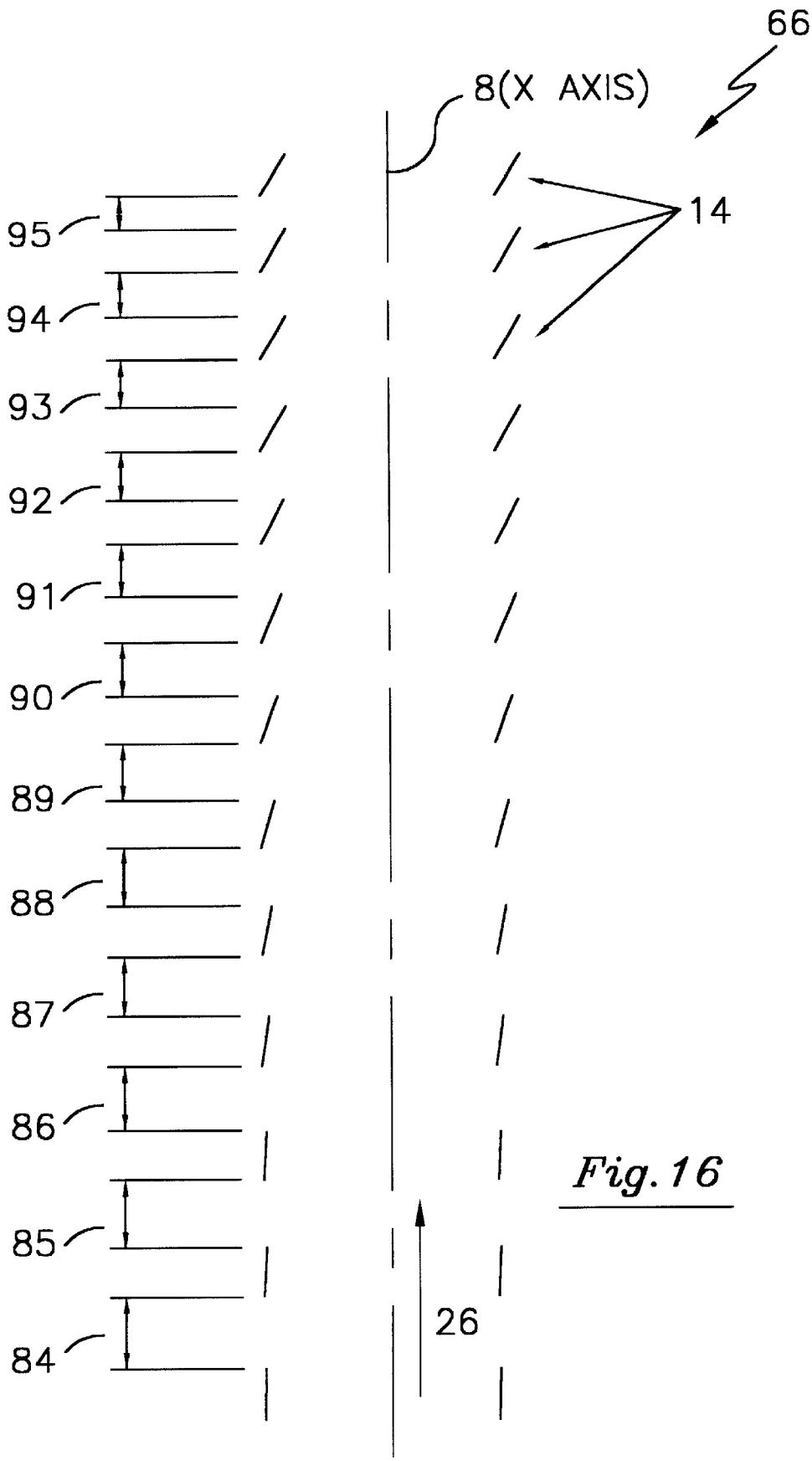
FIG. 16 illustrates a schematic plan view of the ends of vanes of a formed heat exchange element having vanes with different sized spaces between vanes, and adjacent vanes being at different angles to the X axis.

Illustrated in FIG. 16 is a schematic plan view of the vanes of another heat exchange element 66. This element 66 has both the angle (corresponding to angle 19 of FIG. 6) to the X axis 8 increasing in the direction of arrow 26 and the spacings 84 to 95 are also increasing in the direction of arrow 26. This element 66 is effectively a combination of the element 62 and 64, and can be positioned in the flue of a water heater in the same manner as those previously described elements 62 and 64.

Illustrated in FIG. 19, is a cross section through an 8 inch flue which has ten heat exchange elements 2 located around the internal circumference of a flue 52. The vanes 14 on each element 2 have rounded corners 46 and 44, as is also illustrated in FIG. 1. A tool 172 is used to hold the element 2, in position against the flue 52 while the element 2 is being welded into position. The tool 172 has an I shape and is preferably annular.

While the above description and embodiments is directed to a heat exchange element which is adapted to be installed on the internal surfaces of a flue, it will be readily understood by a person skilled in the art that the heat exchange elements of embodiments of the invention will also be able to be positioned on the external surface of a flue and that the rear face of the support member may include a concave contour so as to match an outside circumference of a flue.

Figure 20:
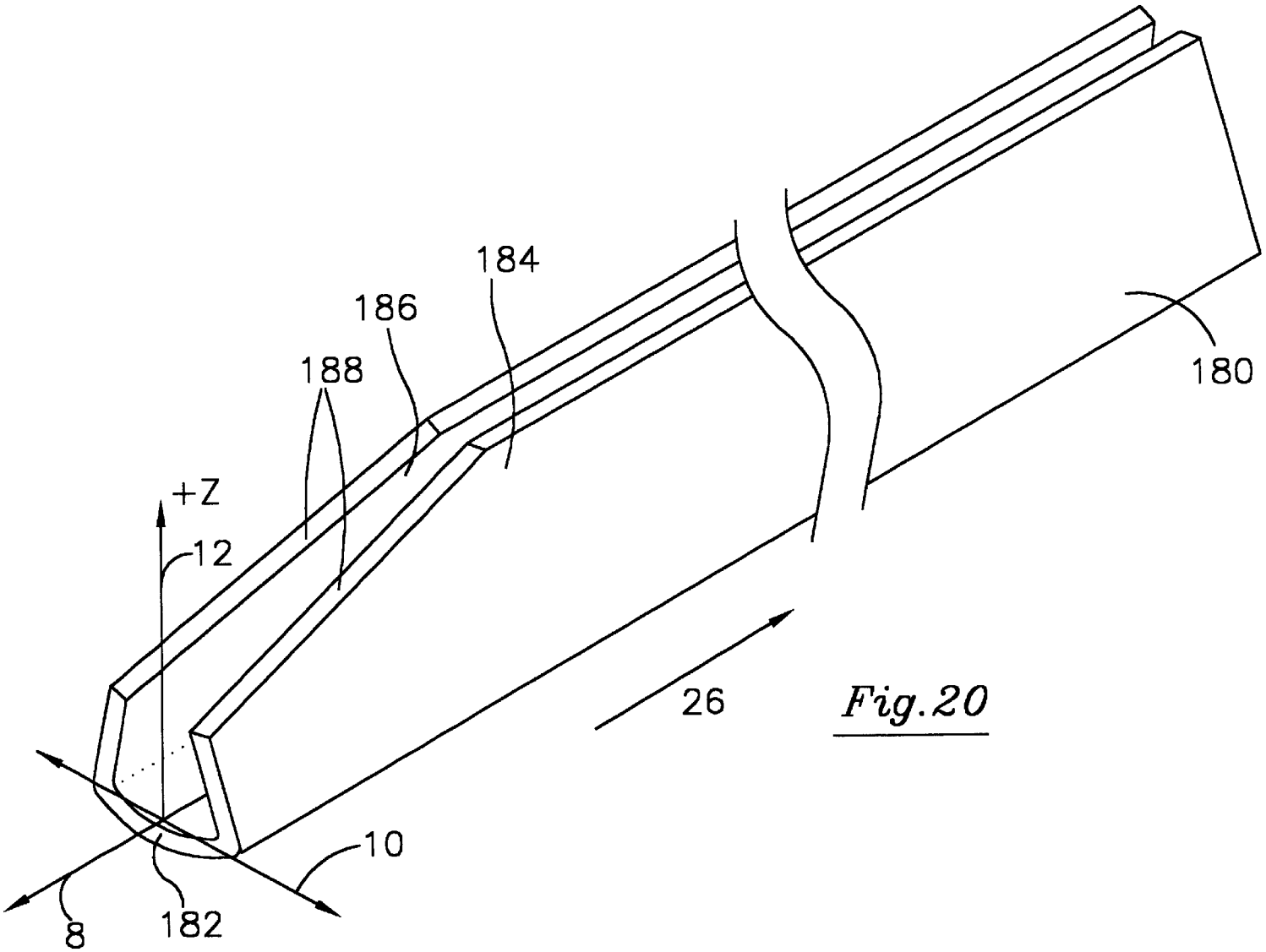
FIG. 20 illustrates a perspective view of a fin or vane of another embodiment of the invention.

Illustrated in FIG. 20 is an elongated heat exchange element 180 which includes a contoured support member 182 and two forwardly extending generally planar vanes 184 and 186. The vanes 184 and 186 extend in the X axis 8 direction as well as the positive Z axis 12 direction. The direction of extension of the vanes 184 and 186 is also at an angle to the Y axis 10. The ends of the vanes 184 and 186 which would lie closest to the combustion chamber end of the flue can include a taper 188 so that the length of the vanes extending away from the support member 182 is reduced. This will decrease the level of heat transfer through the vane, in the same manner and for the same reasons as previously described with respect to the shortened vanes 14 in region 30 of FIG. 1. The heat exchange element 180 does not induce a helical flow path into the exhaust gases.

Figure 22:
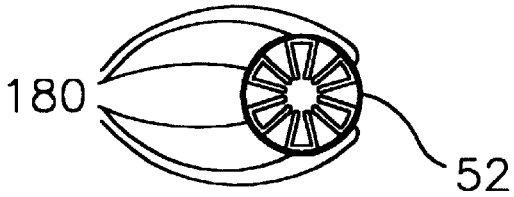
FIG. 22 illustrates a cross section through the flue of the water heater of FIG. 21, showing six vanes of FIG. 20 angularly spaced around the internal surface of said flue.

It will be noted from FIG. 22 that the vanes 184 and 186 of each element are substantially collinear with radii from the central longitudinal axis of the flue 52. Effectively each element 180, is a truncated sector of a circle having an outside diameter equal to the inside diameter of the flue 52.

Figure 21:
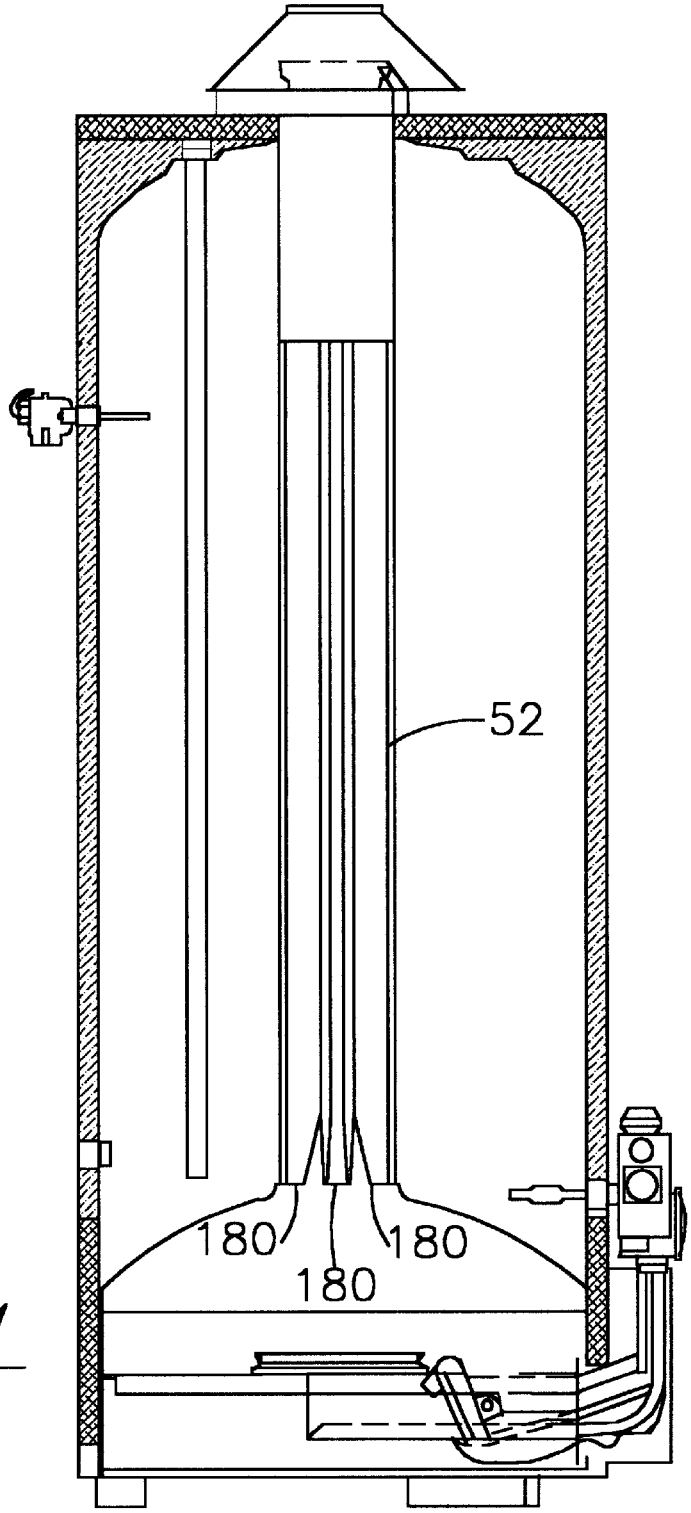
FIG. 21 illustrates a cross section through a fired water heater having the heat exchange element of FIG. 20.

Illustrated in FIGS. 21 and 22 are six heat exchange elements 180, angularly spaced around the internal circumference of a flue 52 of a gas or oil fired water heat, in much the same manner as previously described with respect to the other embodiments of the heat exchange element.

Figure 23:
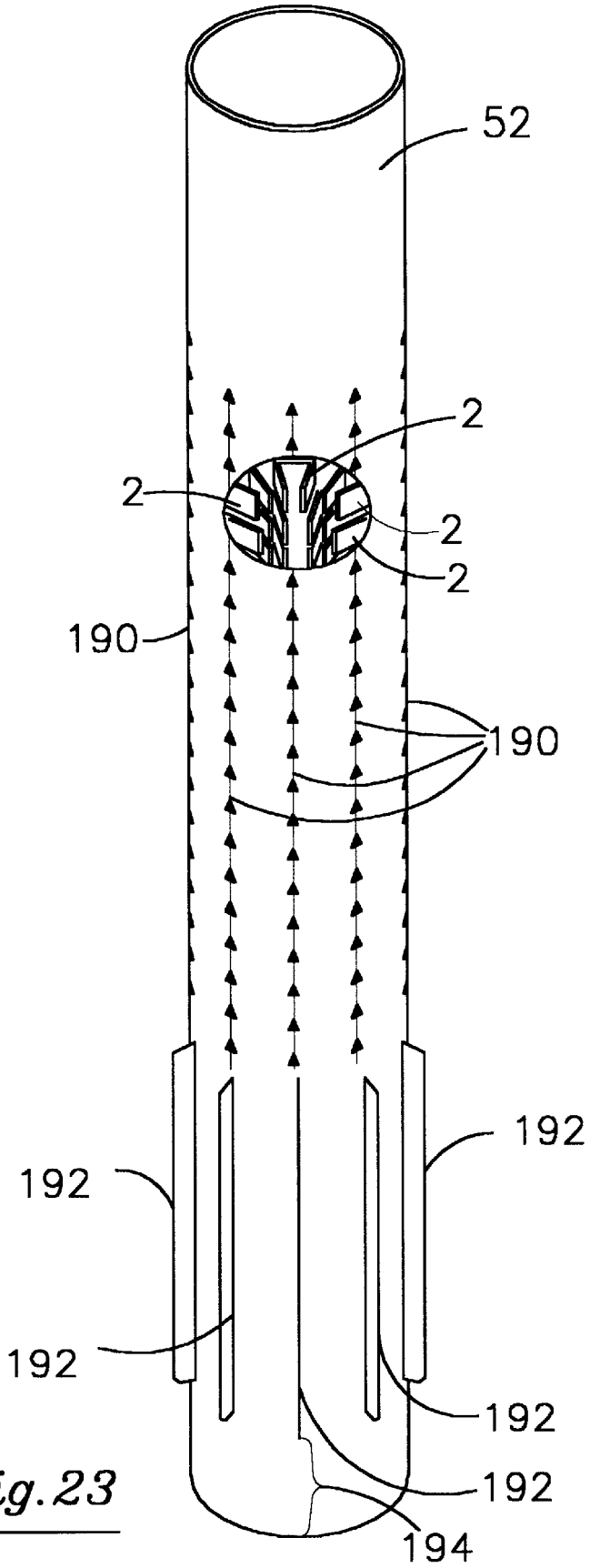
FIG. 23 illustrates a perspective view and part cross section of a flue having internally mounted heat exchange elements, as well as externally mounted fins or vanes.

Illustrated in FIG. 23 is a flue 52 with heat exchange elements 2 (of FIGS. 1 to 3) welded into position around the internal circumference of the flue 52. The weld lines 190 indicate the position of the welds holding the heat exchange elements 2 into position. At the base of the flue, at the combustion chamber end 194, is a series of ten fins or vanes 192 (only five are visible on one side of the flue 52), which are located along the weld lines 190. The vanes 192 are each of a length of approximately 150 mm to 200 mm, approximately 8 mm to 10 mm in thickness and approximately 20 mm in width, with the width being measured perpendicularly away from the flue 52, and the length measured parallel to the longitudinal axis of the flue. The fins or vanes 192 are positioned on the outside of the flue 52, to assist in the reduction of the temperature of the exhaust gases which a would contact the heat exchange element at the combustion chamber end 194. These fins 192 could be used in addition to the tapered lengths of vanes of the heat exchange elements, or, if sufficient heat transfer is available from the fins 192, then they may be able to be used instead of a tapered end of the heat exchange element. To increase the heat transfer capability the fins 192 could be replaced by heat exchange elements as described above with respect to FIGS. 1 to 20.

Figure 24:
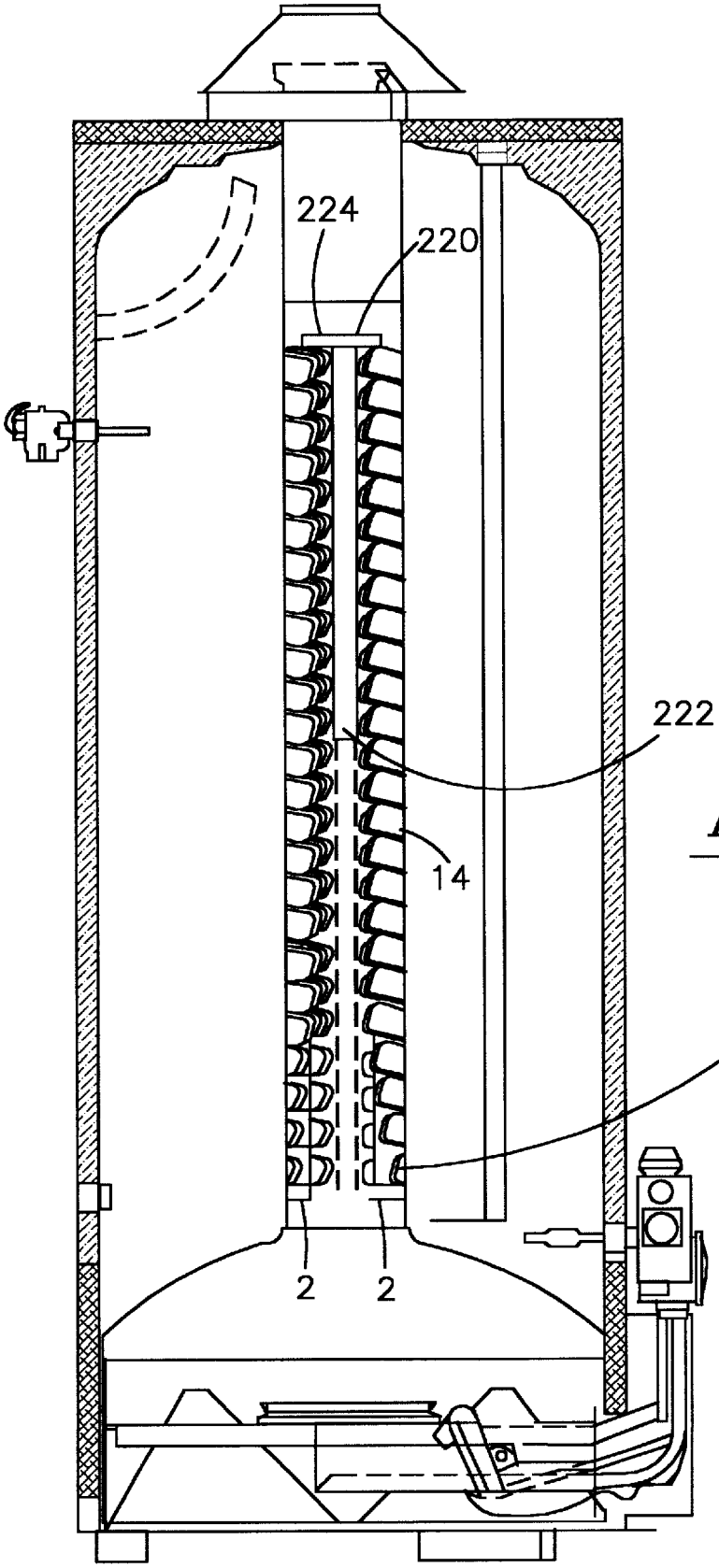
FIG. 24 illustrates a cross section through a water heater with a heat exchanger element of the present inventions together with a baffle.

To improve the efficiency of the heat exchangers elements described above, particularly with respect to the ends of the heat exchange elements which are located at the end of the support member furthest from the combustion chamber baffle can be utilised. Such a baffle is illustrated in FIG. 24 in association with a water heater similar to that illustrated in FIG. 4. It can be seen from FIG. 24 that a baffle 220, which is made from a cylindrical the 222, which is closed off at one end by a disc 224, ensures that at the top end of the flue, the flue gases are forced to pass over the vanes 14 of the heat exchange elements 2. This ensues that the hottest gases which would otherwise be travelling through the centre of the tube, do not by pass the heat exchange elements 2.

One of the advantages of providing the heat exchange element 2 with a longitudinally extending support member, is that any heat concentrations which are present in the wall of the flue adjacent to the combustion chamber end of the support member can be readily and speedily dissipated. By speedy dissipation, the enamel of the flue can be protected better than without the vanes 192 and thus may help to provide a longer service life, together with the ability to manufacture the assembly faster and cheaper, by comparison to prior art methods.

While some of the above embodiments disclose the use of generally planar straight vanes, other shaped vanes such as curved, tapering (eg generally triangular) can be utilised. However, it will also be understood that such vanes may be more time consuming to manufacture and thus more expensive, possibly requiring more complicated forming processes and technology by comparison to the generally rectangular vanes disclosed herein.

It will be understood that the invention disclosed and defined herein extends to all alternative combinations of two or more of the individual features mentioned or evident from the text or drawings. All of these different combinations constitute various alternative aspects of the invention.

The forgoing describes embodiments of the present invention, and modifications, obvious to those skilled in the art, can be made thereto, without departing from the scope of the present invention.

What is claimed is:

1. A heat exchange element affixable to an inside portion of a flue of a combustion apparatus to aid heat transfer through said flue comprising an elongated structure having a first portion and one or two second portions respectively forming a generally L or U shaped cross section, said first portion adapted to be attached to the inside of said flue and having a profile which complements said flue, said one or two second portions including at least one vane extending away from said first portion in a radially inward direction relative to said flue when affixed thereto, said one or two second portions having a length of extension that said one or two second portions extend away from said first portion is shorter at an end of said element located closest to a combustion chamber of said combustion apparatus when affixed to said flue when compared to a length of extension of remaining ones of said one or two second portions.

2. A heat exchange element as claimed in claim 1, wherein said element is formed from a sheet material and folded into a desired shape.

3. A heat exchange element as claimed in claim 1, wherein said element is formed from a channel member.

4. A heat exchange element as claimed in claim 1, wherein said element is formed from a substantially L-shaped member.

5. A heat exchange element as claimed in claim 1, wherein said one or two second portions comprise a plurality of tab or finger elements.

6. A heat exchange element as claimed in claim 5, wherein at least one of said tab or finger elements include a surface oriented at an angle to the longitudinal axis of the flue when mounted therein, in the range of 10° to 35°.

7. A heat exchange element as claimed in claim 6, wherein each tab or finger element is at substantially the same angle to said longitudinal axis of said flue.

8. A heat exchange element as claimed in claim 6, wherein each of or a group of said tab or finger elements is at an angle to the longitudinal axis of the flue which is different from each other of said tabs or finger elements or other groups of said tabs or finger elements.

9. A heat exchange element as claimed in claim 6, wherein said tabs or finger elements or other groups of said tabs or finger elements at one end of said element are at a smaller angle to the longitudinal axis of said flue than said tabs or finger elements or other groups of said tabs or finger elements at the other end of said element.

10. A heat exchange element as claimed in claim 9, wherein the angle, between the longitudinal axis of said flue and each of said tab or finger elements, progressively increases along the length of the element.

11. A heat exchange element as claimed in claim 5, wherein said one or two second portions are part helical.

12. A heat exchange element as claimed in claim 5, wherein gaps or spaces between adjacent tabs or finger elements or adjacent groups of said tabs or finger elements are of a substantially constant dimension.

13. A heat exchange element as claimed in claim 5, wherein gaps or spaces between adjacent tabs or finger elements or adjacent groups of said tabs or finger elements decreases from one end of said element to the other.

14. A heat exchange element as claimed in claim 1, wherein said one or two second portions comprise one vane only with each vane extending parallel to the longitudinal axis of said flue when affixed thereto.

15. A heat exchange element as claimed in claim 1, wherein said profile of said first portion includes a contour which substantially matches the contour of said flue to which it is to be attached.

16. A heat exchange element as claimed in claim 1, wherein said profile of said first portion includes a shape which provides at least one band by means of which said element can contact and be attached to said flue.

17. A heat exchange element as claimed in claim 1, wherein said profile of said first portion includes an radius not larger than an inside radius of said flue.

18. A heat exchange element as claimed in claim 1, wherein at one end of said element said one or two second portions extend the same length from said first portion for a predetermined length of said element, whereupon the length of extension of said one or two second portions from said first portion progressively decreases so that at the end of said element closest to said flue said one or two second portions have their shortest length of extension on said element.

19. A heat exchange element as claimed in claim 18, wherein said predetermined length is in the range of 50% to 80% of the length of said element.

20. A heat exchange element as claimed in claim 1, wherein said one or two second portions are generally planar.

21. A heat exchange element as claimed in claim 1, wherein said one or two second portions impart a motion which is at least part helical, to gases flowing over them when in use.

22. A heat exchange element as claimed in claim 1, wherein said heat exchange element is coated with enamel after it is installed in said flue.

23. A heat exchanger assembly including:

a tubular flue having an internal surface or surfaces about a passageway for gas flow; and a plurality of heat exchange elements as claimed in claim 1 spaced about the axis of the flue and fixed to said internal surface(s) so as to lie in said passage way;

wherein each of said heat exchange elements is substantially aligned with a longitudinal axis of said flue.

24. A water heater comprising a tank adapted to contain water, a combustion chamber with a burner inside providing a source of gaseous products of combustion at a high temperature, a flue tube passing through the tank to transport said products of combustion out of said water heater and to draw heat into water contained in said tank, said flue having attached to it at least one heat exchange element as claimed in claim 1.

25. A water heater as claimed in claim 24, wherein a baffle is located in said flue at a downstream end thereof to direct exhaust gases through said heat exchange elements.

26. A water heater as claimed in claim 25, wherein said baffle includes a cylinder closed at one end.

27. A water heater as claimed in claim 26, wherein said baffle includes a flange at one end of said cylinder to support said end of said cylinder from wherein said one or two second portions of said at least one heat exchange element, with said cylinder extending in an upstream direction from a downstream-most end of said at least one heat exchange element.

28. A heat exchange element affixable to an inside portion of a flue of a combustion apparatus to aid heat transfer through said flue comprising an elongated structure having a first portion and one or two second portions to respectively form a generally L or U shaped cross section, said first portion adapted to be attached to the inside of said flue and having a profile which complements said flue, said one or two second portions including at least one vane extending away from said first portion in a radially inward direction relative to said flue when affixed thereto, said one or two second portions comprising a plurality of tab or finger elements, and wherein at least one of said tab or finger elements includes a surface oriented at an angle to the longitudinal axis of the flue when mounted therein, in the range of 10° to 35°, wherein at one end of said element said one or two second portions extend the same length from said first portion for a predetermined length of said element, whereupon the length of extension of said one or two second portions from said first portion progressively decreases so that at the end of said element closest to said flue said one or two second portions have their shortest length of extension on said element.

29. A heat exchange element as claimed in claim 28, wherein said predetermined length is in the range of 50% to 80% of the length of said element.

30. A heat exchange element affixable to an inside portion of a flue of a combustion apparatus to aid heat transfer through said flue comprising an elongated structure having a first portion and one or two second portions to respectively form a generally L or U shaped cross section, said first portion adapted to be attached to the inside of said flue and having a profile which complements said flue, said one or two second portions including at least one vane extending away from said first portion in a radially inward direction relative to said flue when affixed thereto, said one or two second portions comprising a plurality of tab or finger elements, and wherein at least one of said tab or finger elements includes a surface oriented at an angle to the longitudinal axis of the flue when mounted therein, in the range of 10° to 35°, wherein each of or a group of said tab or finger elements is at an angle to the longitudinal axis of the flue which is different from each other of said tabs or finger elements or other groups of said tabs or finger elements.

31. A heat exchange element affixable to an inside portion of a flue of a combustion apparatus to aid heat transfer through said flue comprising an elongated structure having a first portion and one or two second portions to respectively form a generally L or U shaped cross section, said first portion adapted to be attached to the inside of said flue and having a profile which complements said flue, said one or two second portions including at least one vane extending away from said first portion in a radially inward direction relative to said flue when affixed thereto, said one or two second portions comprising a plurality of tab or finger elements, and wherein at least one of said tab or finger elements includes a surface oriented at an angle to the longitudinal axis of the flue when mounted therein, in the range of 10° to 35°, wherein said tabs or finger elements or other groups of said tabs or finger elements at one end of said element are at a smaller angle to the longitudinal axis of said flue than said tabs or finger elements or other groups of said tabs or finger elements at the other end of said element.

32. A heat exchange element as claimed in claim 31, wherein the angle between the longitudinal axis of said flue and each of said tab or finger elements progressively increases along the length of the element.

33. A heat exchange element affixable to an inside portion of a flue of a combustion apparatus to aid heat transfer through said flue comprising an elongated structure having a first portion and one or two second portions to respectively form a generally L or U shaped cross section, said first portion adapted to be attached to the inside of said flue and having a profile which complements said flue, said one or two second portions including at least one vane extending away from said first portion in a radially inward direction relative to said flue when affixed thereto, said one or two second portions comprising a plurality of tab or finger elements, and wherein at least one of said tab or finger elements includes a surface oriented at an angle to the longitudinal axis of the flue when mounted therein, in the range of 10° to 35°, wherein gaps or spaces between adjacent tabs or finger elements or adjacent groups of said tabs or finger elements decreases from one end of said element to the other.

34. A water heater comprising a tank adapted to contain water, a combustion chamber with a burner inside providing a source of gaseous products of combustion at a high temperature, a flue tube passing through the tank to transport said products of combustion out of said water heater and to draw heat into water contained in said tank, said flue having attached to it at least one heat exchange element, wherein a baffle is located in said flue at an upstream end thereof, to direct exhaust gases through said heat exchange elements.

35. A water heater as claimed in claim 34, wherein said baffle includes a cylinder closed at one end.

36. A water heater as claimed in claim 35, wherein said baffle includes a flange at one end of said cylinder to support said end of said cylinder from wherein said one or two second portions of said at least one heat exchange element, with said cylinder extending in an upstream direction from the downstream-most end of said at least one heat exchange element.

* * * * *

UNITED STATES PATENT AND TRADEMARK OFFICE

CERTIFICATE OF CORRECTION

PATENT NO. : 6,354,248 B1
DATED : March 12, 2002
INVENTOR(S) : Bourke

It is certified that error appears in the above-identified patent and that said Letters Patent is hereby corrected as shown below:

Column 2,
Line 32, please insert -- member -- after “support”.

Column 12,
Line 31, please change “is” to -- this -- after “and”.

Signed and Sealed this

Ninth Day of July, 2002

*Attest:*

*Attesting Officer*

JAMES E. ROGAN
*Director of the United States Patent and Trademark Office*